US005419549A

United States Patent [19]

Galloway et al.

[11] Patent Number: 5,419,549

[45] Date of Patent: May 30, 1995

[54] BASEBALL PITCHER GAME AND TRAINER APPARATUS

[75] Inventors: William R. Galloway, Olathe, Kans.; Richard H. Galloway, Des Moines, Iowa; Allen B. Ellison; Charles R. West, both of Kansas City, Mo.

[73] Assignee: Umlimited Ideas Corporation, Kansas City, Mo.

[21] Appl. No.: 69,303

[22] Filed: May 28, 1993

[51] Int. Cl.[6] ..... A63B 69/00

[52] U.S. Cl. ..... 273/26 A; 273/26 R; 273/26 D; 273/371; 273/374

[58] Field of Search ..... 273/26 A, 26 R, 26 D, 273/371-376, 377, 394; 221/258, 277, 312 R

[56] References Cited

U.S. PATENT DOCUMENTS

| | | | |
|---|---|---|---|
| 3,464,843 | 9/1969 | Hubbard | 273/373 |
| 4,142,723 | 3/1979 | Rief . | |
| 4,177,994 | 12/1979 | Lindquist . | |
| 4,180,726 | 12/1979 | DeCrescent . | |
| 4,199,141 | 4/1980 | Garcia . | |
| 4,272,189 | 6/1981 | Bailey et al. . | |
| 4,275,883 | 6/1981 | Grimaldi et al. | 273/26 A |
| 4,390,181 | 6/1983 | Parish . | |
| 4,561,660 | 12/1985 | Zammuto | 273/376 |
| 4,562,005 | 1/1986 | Hand et al. . | |
| 4,643,423 | 2/1987 | Wright . | |
| 4,657,250 | 4/1987 | Newland et al. | 273/26 A |
| 4,659,090 | 4/1987 | Kustanovich | 273/376 |
| 4,676,504 | 6/1987 | Ponza | 273/26 D |
| 4,763,903 | 8/1988 | Goodwin et al. . | |
| 4,770,527 | 9/1988 | Park | 273/26 A |
| 4,799,688 | 1/1989 | Kellman et al. | 273/371 |
| 4,824,107 | 4/1989 | French | 273/454 |
| 4,830,369 | 5/1989 | Poitral | 273/26 A |
| 4,993,709 | 2/1991 | Tominaga | 273/66 A X |
| 5,029,873 | 7/1991 | Davis | 273/376 |
| 5,046,729 | 9/1991 | Yancey | 273/26 A |
| 5,056,782 | 10/1991 | Giovagnoli | 273/26 R |
| 5,064,092 | 11/1991 | Grossi | 221/75 |
| 5,064,194 | 11/1991 | Bixler et al. | 273/26 A |
| 5,193,816 | 5/1993 | Ahmed et al. | 273/373 |
| 5,195,652 | 6/1993 | Houghiemstra et al. | 221/203 |
| 5,230,505 | 7/1993 | Paquet et al. | 273/26 A |

*Primary Examiner*—V. Millin
*Assistant Examiner*—Kerry Owens
*Attorney, Agent, or Firm*—Litman, McMahon & Brown

[57] ABSTRACT

A baseball pitcher game and training apparatus includes a free swinging target receptacle which is positioned at one end of an elongate enclosure with a player's station positioned at the opposite end of the enclosure. A target is removably positioned in the target receptacle, with the target including a target image printed thereon. An X-Y grid of conductive lines scanned by a target processor determines the position at which a thrown ball impacts the target and the direction and magnitude of spin of the ball. A radar gun positioned in the elongate enclosure has a beam directed across the flight path of the ball to determine the speed of the thrown ball. A game computer is programmed for a game strategy and methodology which rewards throwing speed and accuracy and includes an interactive voice module for verbal feedback to the player. An improved ball return mechanism permits balls to be selectively and reliably returned and dispensed to a player.

53 Claims, 27 Drawing Sheets

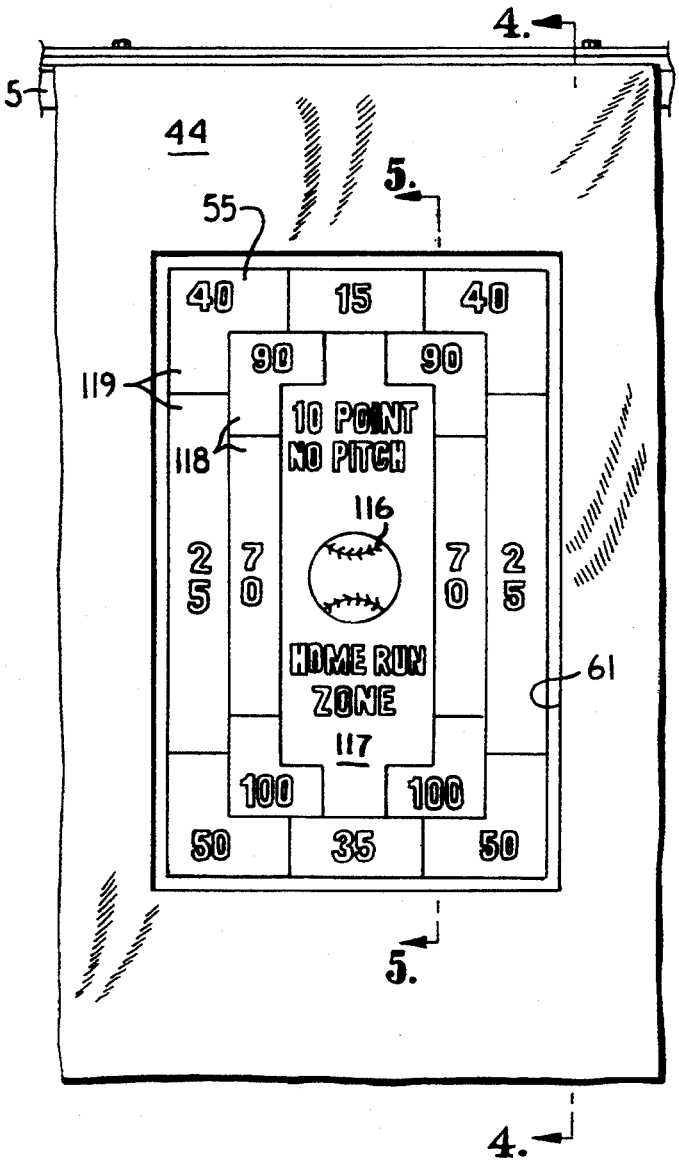
Fig.3.
Fig.4.
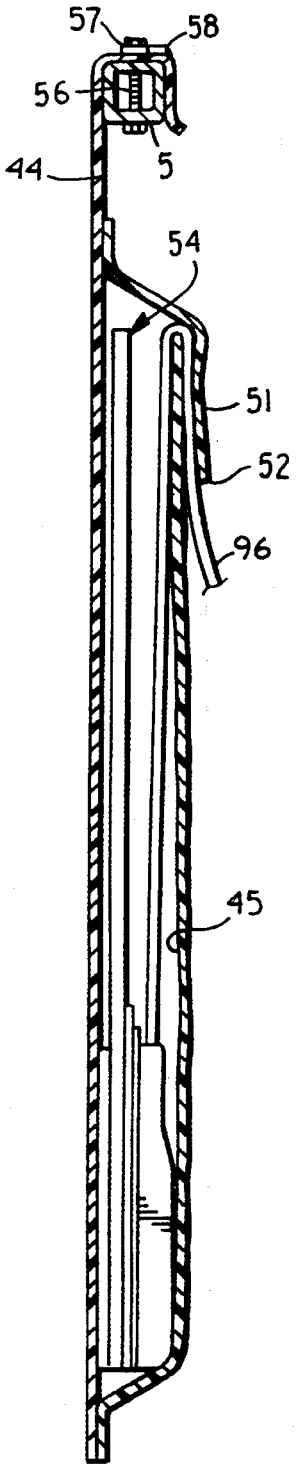
Fig.5.
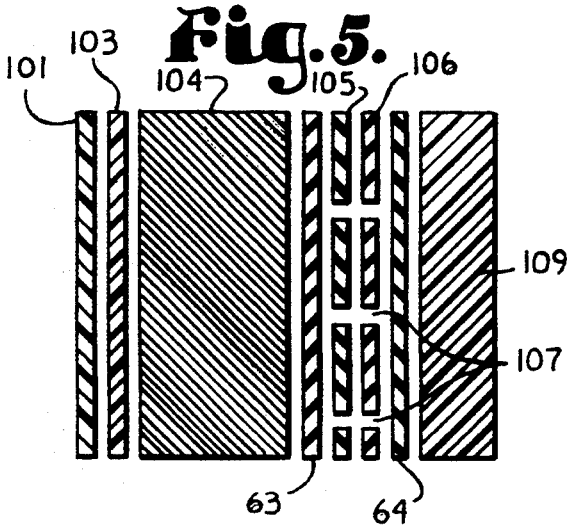

START
261
162
IS GAME OVER ?
NO
YES
263
ANY BUTTON PRESSED ?
NO
YES
264
DIAG BUTTON ?
YES
NO
ANY CREDITS ?
NO
YES
YES
ONE PLAYER BUTTON ?
NO
266
YES
A
281
TWO PLAYER BUTTON ?
NO
267
YES
B
282
271
UNSPECIFIED TEST
TRAIN BUTTON ?
YES
IN TRAIN MODE ?
NO
YES
272
MODE = TRAINING
MODE = NORMAL
273
LIGHT TRAINING LAMP
LIGHT NORMAL LAMP
END

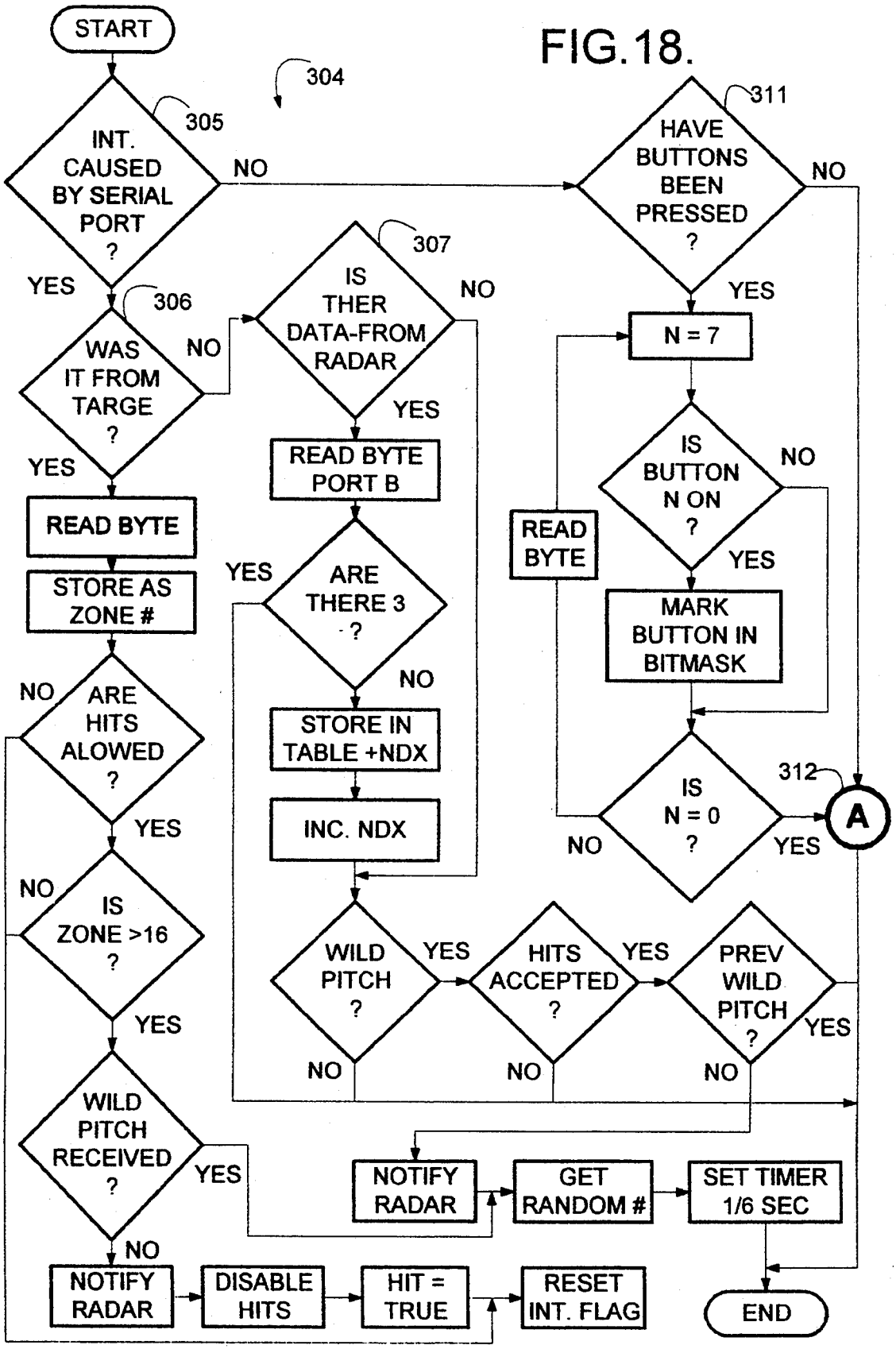
FIG.18.
START
304
305
INT. CAUSED BY SERIAL PORT ?
NO
YES
306
WAS IT FROM TARGE ?
NO
YES
READ BYTE
STORE AS ZONE #
NO
ARE HITS ALOWED ?
YES
NO
IS ZONE >16 ?
YES
WILD PITCH RECEIVED ?
YES
NO
NOTIFY RADAR
DISABLE HITS
HIT = TRUE
RESET INT. FLAG
307
IS THER DATA-FROM RADAR
NO
YES
READ BYTE PORT B
YES
ARE THERE 3 ?
NO
STORE IN TABLE +NDX
INC. NDX
WILD PITCH ?
YES
NO
HITS ACCEPTED ?
YES
NO
PREV WILD PITCH ?
YES
NO
NOTIFY RADAR
GET RANDOM #
SET TIMER 1/6 SEC
END
311
HAVE BUTTONS BEEN PRESSED ?
NO
YES
N = 7
IS BUTTON N ON ?
NO
YES
MARK BUTTON IN BITMASK
READ BYTE
312
IS N = 0 ?
NO
YES
A START
370
ARE BOTH PLAYERS LEGAL ?
371
NO
TAKE GAME OUT OF PLAY MODE
DISABLE HITS
YES
MELTING SCORE ?
YES
ADD REMAINING SPEED TO SCORE
372
NO
HAS GAME SWITCHED PLAYER ?
YES
NO
373
TURN ALL LAMPS OFF
374
GOTO NEXT PLAYER
375
RESTORE PLAYER LAMPS
376
RESTORE ROUND LAMPS
377
RESTORE SCORE
378
RESTORE MODE LAMPS
END 410
411
START
HAS PLAYERS GAME ENDED ?
YES
NO
RECORD SCORE
IS SCORE > HIGHEST SCORE ?
YES
HIGHEST SCORE = SCORE
NO
HIT DEAD MAN SWITCH
IS SCORE < 200
NO
IS SCORE > 400 ?
YES
NO
YES
HARASS PLAYER
COMPLEMENT PLAYER
INCREMENT ROUND
LIGHT ROUND
IS ONE PLAYER GAME ?
NO
IS OTHER PLAYER LEAGAL ?
YES
YES
NO
LOCKOUT BALL RETURN
GAME OVER = TRUE
NOTIFY OLAYER
END START
CONFIGURE FPGA'S
431
430
432
DETECT SHORTS
433
START AT ROW 0
IS THERE INTERRUPT ?
434
YES
NO
GO TO NEXT ROW
435
HAS REACHED BOTTOM OF TARGET ?
436
NO
YES
440
READ ENTIRE ROW
437
COMPENSATE FOR SHORTS
438
ARE THERE STILL VALID JUNCTIONS ?
439
NO
YES
OBTAIN FOOTPRINT
441
CALCULATE CENTROID
442
MAP X,Y TO ZONE
443
XMIT ZONE TO TARGET
444

BASEBALL PITCHER GAME AND TRAINER APPARATUS

BACKGROUND OF THE INVENTION

1. Field of the Invention

This invention is directed to a baseball pitcher game and training apparatus and more particularly to such an apparatus in which a player throws a ball at a target positioned within an elongate enclosure, A scanned X–Y sensing matrix of conductive rows and columns in the target detects the position of the ball as it strikes the target. A radar gun detects the passage of the thrown ball through a zone and provides a readout of ball speed, A game methodology awards points for speed and throwing accuracy, 2. Description of the Related Art A number of prior art attempts have been made to create a baseball pitcher's target which provides meaningful feedback to the pitcher regarding pitching accuracy, Some of these prior art devices have included a game methodology or a scoring system designed to award points for accuracy, One such prior art-device is described in U.S. Pat. No. 4,199,141 to Garcia, in which a number of target zones on a pitcher's target each include a mechanical switch which closes an associated electrical circuit if struck by a thrown ball. Additional, smaller plunger-type switches in a strike zone area are used for a game with various points or "hits", "doubles", "triples", etc. awarded for striking these targets in a game. Accompanying audio and visual indications are also provided. U.S. Pat. No. 4,830,369 to Poitras is directed to a similar baseball pitching target with zoned switches, indicator lights and pitch counters. U.S. Pat. No. 5,029,873 teaches yet another zoned target area, but uses individual piezo-electric impact detectors in each target zone to detect ball impact. U.S. Pat. No. 5,046,729 to Yancey is directed to a pitcher's target with an array of zones, each with an electrical switch closed upon ball impact. An array of lights arranged on three sides of the target provides an indication of the zone struck.

U.S. Pat. No. 4,390,181 to Parish is directed to a practice pitching apparatus in which a strike area and a ball area are included in a target. The strike area is indented relative to the ball area and each includes an electrical switch pair to indicate and totalize balls and strikes. Visual indicators and automatic reset circuitry are provided as well.

U.S. Pat. No. 4,643,423 to Wright is directed to a pitcher's target including a resilient, energy absorbing free hanging screen with a target printed thereon. Balls striking the screen fall into a trough positioned below the screen.

U.S. Pat. No. 5,064,194 to Bixler et al. is directed to a pitcher's target which includes a central target opening surrounded by adjacent hinged trapezoidal "wings". If a thrown ball hits the central opening, no indication is given, but if one of the trapezoidal wings is hit, it pivots to cause an electrical contact to close, giving a visual indication of "high", "low", "inside" or "outside"

While each of the above-listed patents uses a relatively simple electrical contact to indicate impact and impact zone, a number of more sophisticated targets and position, speed or force sensors have been developed as well.

For example, U.S. Pat. No. 4,770,527 to Park is directed to a photo-electric projectile speed sensing arrangement for a projectile such as a thrown baseball. A crossed matrix of photo-electric sensors, and associated beams arranged in a target box detects the entry of the projectile into the box. A piezo-electric planar transducer positioned a set distance behind the photo-sensor array detects an impact of the projectile. A computer calculates the time between entry and arrival at the planar transducer to calculate the speed. The planar transducer can be divided into different target areas or zones.

U.S. Pat. No. 4,659,090 to Kustanovitch is directed to a force sensing target which includes a plurality of overlying layers. Some of the layers are continuously electrically conductive, such as metallized sheets, some are selectively conductive, to indicate target zones, and the remainder are dielectric. When a projectile strikes the target, a sensor detects a change in a first capacitance variable due to deformation of the dielectric layers and a processor computes a force value dependent thereon. Changes in another capacitance variable are used to determine the zone of impact.

U.S. Pat. No. 4,563,005 to Hand et al. is directed to a baseball position sensing apparatus in which a pair of infrared emitter and sensor arrays are positioned on either side of a target area. The emitters are scanned, with each, in sequence, emitting a short optical pulse signal. The sensors detect the optical pulses and generate a digital word based upon the received pulses. When a baseball enters the target area, some of the scanned optical pulses will not be received by respective sensors, and a computer calculates the baseball position based upon this digital word. By positioning two such emitter-sensor arrays on each side of the target area, the velocity of the baseball can be calculated based upon elapsed transit time of the ball between arrays.

U.S. Pat. No. 4,657,250 to Newland et al. is directed to a pitching practice apparatus including a crossed grid of optical emitters and photodetectors which determine ball location. A speed gun determines ball speed and a spring loaded ball return panel, positioned behind the photodetector grid, absorbs the impact of the thrown balls and returns them to the thrower via a ball return trough.

Each of these systems represents a relatively complex technique for detecting ball position, force and/or velocity. Optical detection systems, such as those of Hand et al. and Park, are particularly susceptible to erroneous readings due to dust particles, insects,, or other extraneous material breaking or partially breaking the optical beams. They are also subject to frequent failure and require considerable maintenance due to burn-out of emitters. Furthermore, optical sensing systems are particularly prone to giving false readouts since light from one emitter can reflect off of the ball or other projectile and impinge on an unrelated photosensor. Thus, ghost images are sensed and it is virtually impossible to determine which position is real. Capacitance based systems, such as that of Kustanovitch, are less prone to failure, but are also subject to erroneous readouts due to extraneous electrical signals including static electricity. Furthermore, the system of Kustanovitch, with it's continuous electrical conductors, is capable of giving only gross approximations of impact position and force.

It is clear then, that a need still exists for a reliable baseball pitcher's game and training apparatus which is extremely rugged and durable, requires minimal maintenance, yet is sophisticated enough to allow the use of programmed game methodologies. Such an apparatus should be compact enough to be positioned in amusement arcades without taking up a large amount of floor space. The apparatus should reliably detect both the exact position of impact and the speed of a thrown baseball, should be designed to absorb the shock of impact of a ball striking a target without rebounding toward the thrower and without damaging the target, and should be capable of both audio and visual feedback including computerized scoring. For more sophisticated applications, the apparatus should be capable of detecting the direction and magnitude of spin of a thrown ball.

SUMMARY OF THE INVENTION

In the practice of the present invention, a baseball pitcher game and training apparatus includes a free swinging target receptacle positioned at one end of an elongate enclosure. A pitcher's station is positioned at the opposite end of the enclosure from which a player throws balls at a target. The target is removably positioned in the target receptacle, with the target itself having a plurality of laminated layers. A first, transparent outer layer includes a printed target image silk-screened on the back side thereof with a wrinkle preventive layer overlayed over the target image. Next a relatively thick, energy absorbing layer of Poron or a similar material is included, and then a first circuit layer. A pair of dielectric layers including a matched plurality of apertures are sandwiched between the first circuit layer and a second circuit layer. The last laminate layer is a stiff backing material, such as Lexan.

The first and second circuit layers; each include a plurality of parallel conductive lines, with the lines in the first layer comprising horizontal rows and the lines in the second layer comprising vertical columns, with the combination representing an X–Y matrix. Each aperture in the dielectric layers is positioned between a junction of the orthogonal conductive rows and columns. A target processor scans the horizontal conductive rows by applying a preset voltage to each individual row in succession. A thrown ball which impacts the target forces the first circuit layer inward at the point of contact, causing the conductive rows around the point of impact to bridge the gap created by the apertures in the dielectric layers. Thus, the rows in the vicinity of the impact point contact respective vertical columns in the second circuit layer. The scanning voltage applied to the rows is thus conducted to the contacted columns and the processor detects this voltage on the affected columns. The impact point can be determined from the intersection of the scanned rows and the affected columns. The centroid of force can also be determined by the pattern of conductive intersections. Since the scanning rate is extremely rapid, e.g. almost 50,000 per second, a number of patterns of impact points, or ball "geographical footprints" are determined as the force of the ball is absorbed by the target. By analyzing the progression of impact patterns, it can be determined what direction the ball is moving as it impacts the target. From this information, it is possible to determine the direction and to calculate the magnitude of spin on the ball, since a ball will move in the same direction on the target as it is spinning, with the mount of movement indicating the magnitude of ball spin. In other words, a ball which has top spin will tend to move in an upward direction on the target surface while a ball with side spin, either right or left, will tend to move to the right or left, respectively. Thus, since it is the spin on a baseball which determines its flight path through the air, a programmable game computer connected to the scanning processor can be programmed to indicate whether a thrown ball is a curve, slider, sinker, screwball, etc., based upon the sequence of centroids of ball "geographical footprints" sent to it by the target processor.

A radar gun positioned in the elongate enclosure has a beam directed through the flight path of a ball thrown at or near the target. The radar gun determines the speed of the thrown ball as it traverses the radar beam. The radar gun, provided that the radar beam has a broad enough cross section, can also be used to determine that a ball has been thrown if the ball does not impact the target. Thus, throws which are "Wild Pitches" will be counted as throws or events, and as "Balls". A piezoelectric transducer is also built into the target board to detect instances where a thrown ball should impact the edge of the target or the target receptacle but not impact the target in the area of the orthogonal conductive matrix. The elongate enclosure includes an improved ball return mechanism whereby a ball which drops from the target rolls down an inclined ramp to an enclosed ball storage area. The ball storage area is contoured such that balls tend to roll toward a ball return tube. The ball return tube includes a spiral spring attached to a motor which turns the spring in a direction which forces balls from the ball storage area up the tube to exit at the top of the tube.

The game computer is programmed for a game strategy and methodology in which a player throws balls at the target and accumulates a running score. Each game encompasses the pitching sequence for a single batter, i.e. the game ends when the pitcher either Strikes out or walks the batter. The score is derived from a point system for accuracy which is added to the speed of each throw in miles per hour. The target is divided into impact zones, with impact zones in the Strike zone, but at the corners of home plate or at the bottom of the Strike zone assigned maximum point values. The Strike zone at the center of home plate and higher in the Strike zone is labeled a "Home Run" zone and is assigned negative points. Balls outside, but close to the Strike zone are assigned lesser numbers of points. The object of the game is to accurately throw balls to achieve the maximum score. This is accomplished by throwing balls at maximum speed and accuracy to achieve a full count of three Balls and two Strikes with the last throw being a Strike. Each Strike should preferably be at the "corners" or low in the Strike zone. Balls outside the target area are "Wild Pitches" which are assigned no score for speed or location, but are counted as Balls.

The game computer is equipped with a digital voice storage module capable of delivering up to 14 minutes of stored speech. Thus, initial attractive announcements, such as "Play Ball" can be periodically transmitted. During actual play an intermittent series of interactive voice messages will inform, praise or admonish the player depending upon results. Balls and Strikes are announced just as a live umpire would call them. The game can be programmed to allow a player to pitch to a single batter, to complete an inning, or to pitch an entire "game" of nine innings.

OBJECTS AND ADVANTAGEOUS OF THE INVENTION

The principle objects and advantages of the present invention include: to provide an improved baseball pitcher's game and training apparatus; to provide such an apparatus in which a pitching target is positioned in a target receptacle at one end of an elongate enclosure with a player positioned at the opposite end; to provide such an apparatus in which the target receptacle and target are suspended so as to be free swinging to better absorb the impact of thrown baseballs; to provide such an apparatus in which the target includes a crossed X–Y grid of conductive lines in which the X and Y lines are normally separated, but are shorted together by the impact of a thrown ball in the vicinity of the ball's impact position; to provide such an apparatus in which a speed radar gun is mounted to determine the speed of a ball thrown at the target; to provide such an apparatus in which the direction and magnitude of spin on a thrown ball can be determined by the direction and extent of deflection of the ball as it impacts the target; to provide such an apparatus in which a target processor determines the location and spin of a thrown ball by determining the position of impact and the behavior of the ball after impact; to provide such an apparatus in which a programmable game computer is programmed to implement a game methodology giving a score based upon the speed and accuracy of thrown baseballs; to provide such an apparatus in which the programmable game computer is programmed to implement an alternative training methodology which gives a player a specific target to aim at and provides interactive feedback based upon results; to provide such an apparatus in which a digital voice storage module provides an interactive verbal communication with a player or players; to provide such an apparatus which includes a convenient and reliable ball return for returning and selectively dispensing balls to a player after they impact and drop from the target; and to provide such an apparatus which is rugged and reliable, convenient to assemble, disassemble and transport, and which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 3 is an enlarged fragmentary, cross-sectional view of the baseball pitcher's game and training apparatus, taken along line 3—3 of FIG. 2, and illustrating a frontal view of a target and target receptacle.

FIG. 4 is an enlarged cross-sectional view of the target, target receptacle and mounting structure, taken along line 4—4 of FIG. 3, and illustrating a target holding pouch.

FIG. 5 is a greatly enlarged, cross-sectional view of the target, taken along line 5—5 of FIG. 3, and illustrating the laminated structure of the target board.

FIGS. 18 and 19 are flow diagrams illustrating portions of an interrupt handling routine of the software of the baseball apparatus.

detailed description of the invention

I. Introduction and Environment

Figure 1:
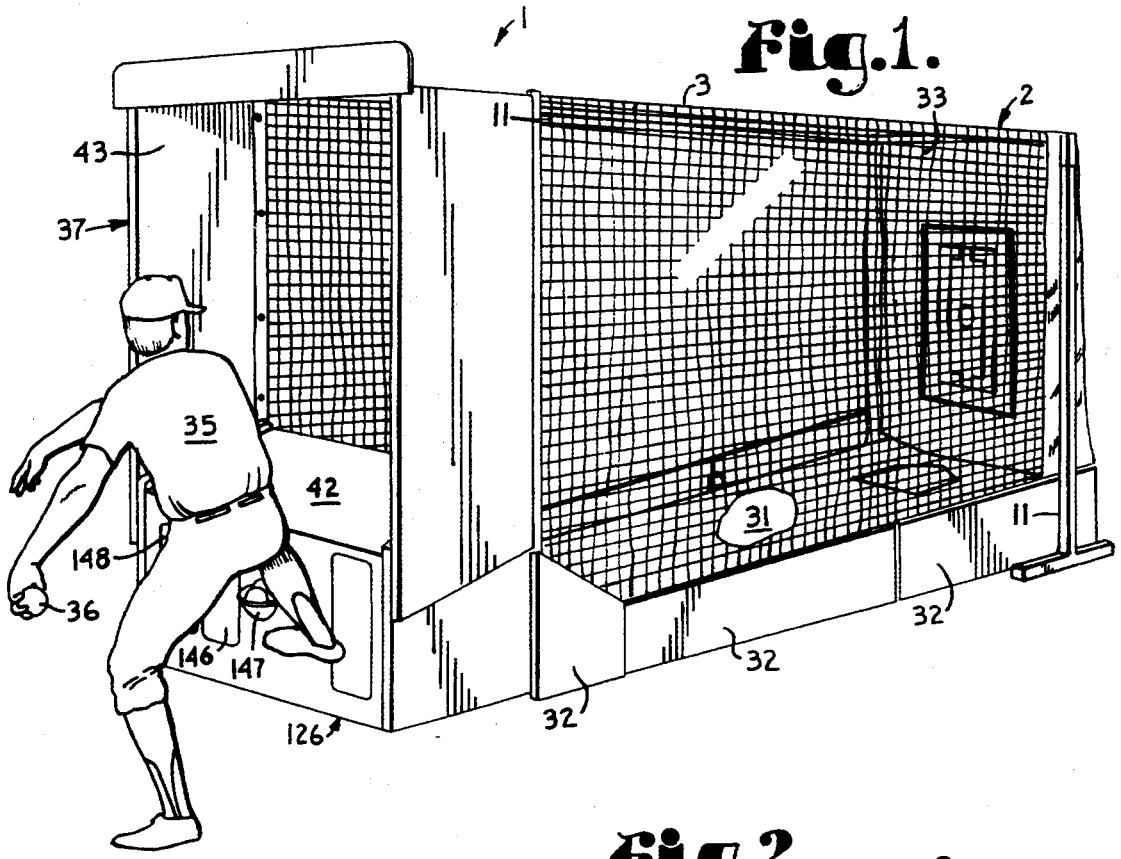
FIG. 1 is a perspective view of a baseball pitcher's game and training apparatus in accordance with the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Game General Overview and Enclosure

Referring to the drawings in more detail the reference numeral 1 in FIG. 1 generally designates a baseball pitcher's game and training apparatus in accordance with the present invention. The apparatus 1 includes an elongate enclosure 2 made up of top longitudinal frame members 3, top transverse frame members 5 (FIGS. 3 and 4), and a plurality of upright corner frame members 11. A number of ramp supports 21 are arranged on either side of the enclosure 2 and are graduated in height to support a ball return ramp 31 in an inclined orientation such that balls tend to roll from right to left in FIG. 2. A plurality of removable side panels 32 provide rigidity to the enclosure 2 while allowing it to be easily assembled and disassembled. A net 33 is attached to complete the enclosure 2 along both sides, the top, and around a target end 34 to prevent wildly thrown or ricocheted balls from leaving the confines of the enclosure 2.

A player 35 is shown in the act of throwing a ball 36 from a player's station 37 at an end of the enclosure 2 opposite to the target end 34. A scoreboard and control panel 42 is positioned in front of the player 35 beneath a rectangular opening 43 through which the ball 36 is to be thrown.

A target receptacle 44 includes a target pouch 45 (FIGS. 3 and 4), which is closed by a flap 51 equipped with a hook and loop fastener 52 for keeping the flap 51 closed. A target and processor assembly 54 is inserted into the pouch 45, with a target image 55 appearing through a rectangular opening 61 in the front of the target receptacle 44. The target receptacle 44, which may be made of, for example, nylon-reinforced PVC, is suspended from the top transverse frame member 5. Since the target receptacle 44 is suspended only from the top, it is free to swing to and fro beneath the supporting frame member 5. This permits the target receptacle 44 and the target and processor assembly 54 to absorb a portion of the energy of a thrown baseball by translating some of that energy into translational motion of the target receptacle 44 and target and processor assembly 54. To hold the target receptacle in place, a through bolt 56 extends through a metal retaining strap 57 which extends along the frame member 5. A plastic or Nylon material strip 58 is glued or otherwise attached to the target receptacle 44 to prevent the receptacle 44 from being torn or pulled out from under the metal retaining strap 57 due to the force of impacting balls.

Target and Target Processor Assembly

Figure 6:
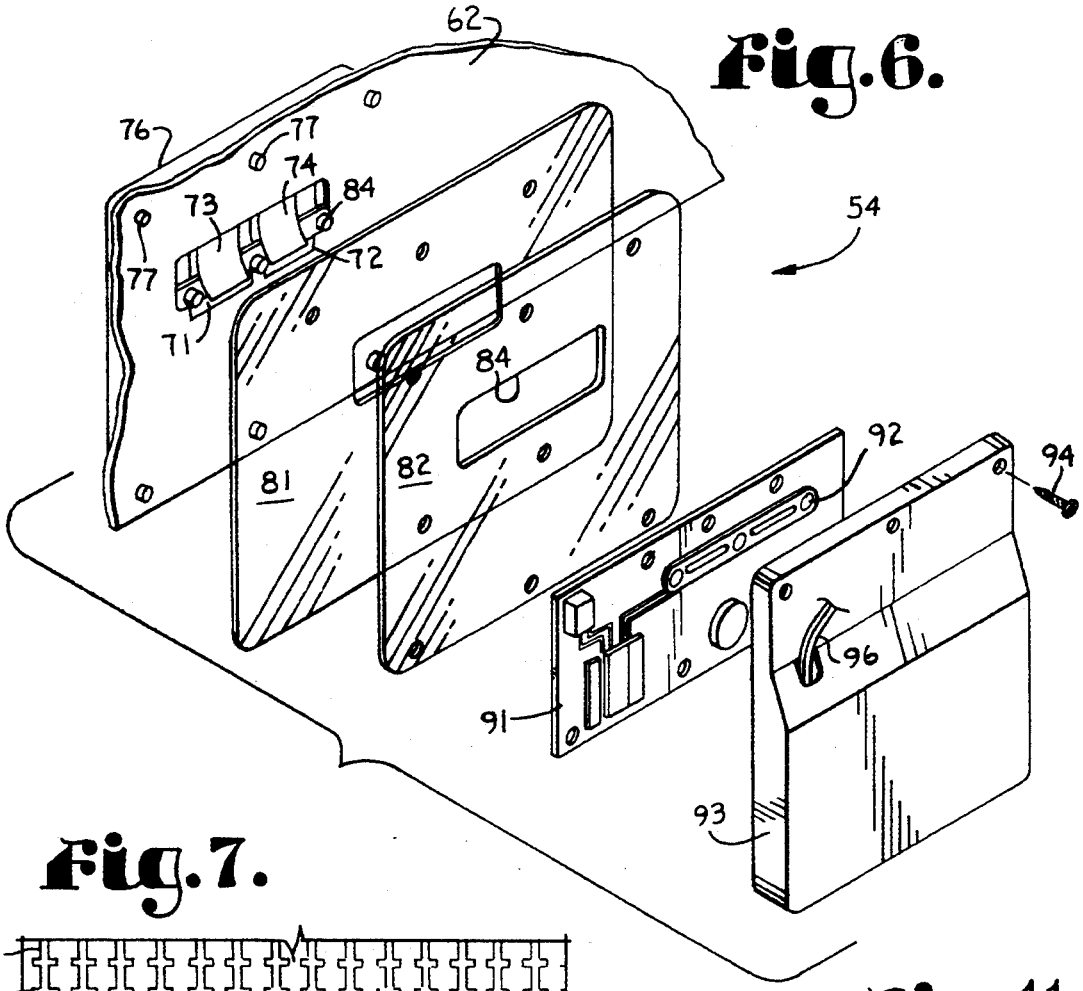
FIG. 6 is an enlarged, exploded view encompassing a portion of the target board, a plexiglass protector, a processor housing and a processor circuit board, illustrating the method of attachment of the processor to the target board.
Figure 7:
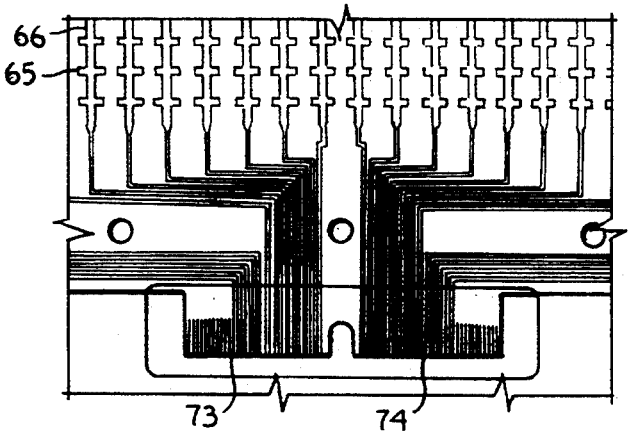
FIG. 7 is a greatly enlarged, fragmentary view of a portion of the target board including some of the conductor matrix and a pair of ribbon connectors.
Figure 12:
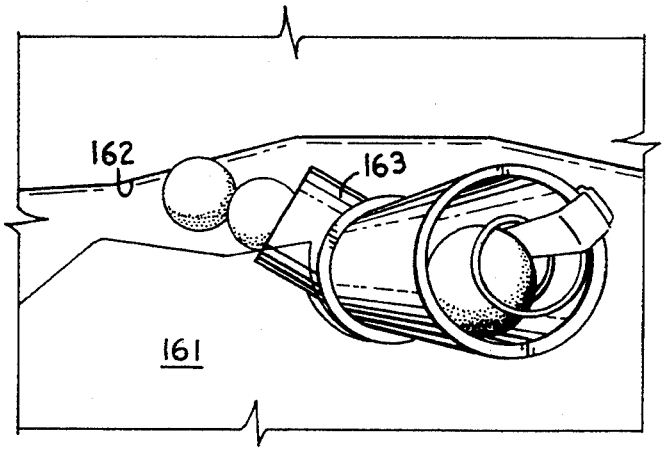
FIG. 12 is a block electrical diagram illustrating the target processor CPU, column and row field programmable gate arrays, and their connection to a portion of the conductive line X–Y matrix.

The target and processor assembly 54 is shown in an exploded view in FIG. 6. A target board 62 is essentially a greatly enlarged touch panel specially adapted to sense the position of a thrown baseball. The target board 62 is constructed of a number of composite layers which will be more fully described below with reference to FIG. 5. Within the target board 62 are a pair of circuit layers 63 and 64 (FIG. 5), with the layer 63 including a plurality of parallel horizontal conductive lines or rows 65 while the layer 64 includes a plurality of vertical conductive lines or columns 66 (FIGS. 7 and 12). The rows 65 terminate in a pair of conductive ribbons 71 and 72 while the columns 66 terminate in a pair of conductor ribbons 73 and 74.

The target and processor assembly 54 includes a processor assembly including a front processor housing member 76 with a number of threaded female screw receptacles 77. The receptacles 77 are arranged to protrude through corresponding openings in the target board 62. A relatively large and generally rectangular protective panel 81 is positioned on the opposite side of the target board 62 and an additional, smaller rectangular protective panel 82 is placed over the larger board 81. The edges of the panels 81 and 82 are rounded to minimize stress from impacts, and the graduated size of the panels allows the larger panel 81 to flex over the edges of the smaller panel. 82 to reliably absorb impact forces. Each of the panels 81 and 82 includes openings 83 which match the openings in the target board 62 and rectangular openings 84 for admitting conductive ribbons 71–74. A connector block 85 is positioned between the conductive ribbons 71 and 72 and mating contacts on an integrated circuit target processor panel 91. The processor panel 91 is then positioned over the block 85, with an additional connector block 92 placed thereover. The blocks 85 and 92 make contact between conductor ribbons 71, 72 and 73, 74, respectively, and corresponding sides of the processor panel 91. A rear processor housing member 93 is then positioned to overlie the assembled target and processor assembly 54 and is connected to the front processor housing 76 via a plurality of screws 94. The target and processor assembly 54 is connected to a game computer 95 (FIG. 9) via a ribbon cable 96.

FIG. 5 is a cross-section of the target board 62 showing the various laminated layers within the board 62. A first layer 101 is a 10 Mil Mellanex Polyester sheet with the target image 55 (FIG. 3) silk screened on the back. Layer 103 is a 7 Mil sheet of polyester which is designed to reduce wrinkling. Layer 104 is an energy absorbing layer made of ⅛" thick Poron. Layer 63 is a 7 Mil polyester circuit layer with a number of the parallel horizontal conductive rows 65 placed thereon on a side facing layer 105. Layers 105 and 106 are adjacent dielectric layers with a number of apertures 107 extending through both. The layer 64 is a second 7 Mil Polyester layer with a number of the conductive columns 66 placed thereon facing the layer 106. The columns 66 are orthogonal to the rows 65 on layer 63, with the combination comprising an X–Y matrix. The apertures 107 in the layers 105 and 106 are positioned at all points where the parallel rows 65 intersect with the parallel columns 66.

When a thrown ball, such as the ball 36, hits the target board 62, the layers are deflected inward, with the conductive rows on the layer 63 being pushed into contact with the conductive columns on the layer 64 through the apertures 106 in the vicinity of the striking ball 36. This shorts the conductive rows 65 and columns 66 together at intersecting locations in the impact area.

Figure 11:
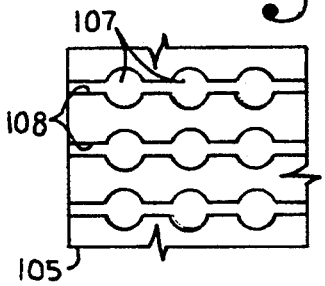
FIG. 11 is a greatly enlarged view of a portion of the target board, illustrating the construction of the dielectric conductor matrix separating layers.

Referring to FIG. 11, an enlarged view of a portion of the dielectric layers 105 shows that the apertures 107 are not continuous circles of dielectric material, but instead are configured to leave an air gap 108 between each adjacent pair of the apertures 107. This arrangement allows air to escape from the target board 62 as a ball impacts it. Thus, no air is compressed between the rows 65 and columns 66 and a better impact footprint is developed. In addition, if air were compressed at each intersection with each ball impact, the internal pressure within the target board 62 would tend to delaminate the board 62 and eventually destroy it. The dielectric layer 106 has an identical configuration.

Referring again to FIG. 5, a final layer 109 is a 60/1000" backing layer of Polycarbonate Lexan or the like. It should be noted that FIG. 5 is not to scale, but is somewhat representative of the relative thicknesses of the various layers.

Referring to FIG. 3, the target image 55 is shown illustrating the target impact zones and various points available when each zone is hit. A baseball image 116 in the center denotes a "Home Run" zone which subtracts 20 points from the player's score when it is impacted. Outside of the home run zone 116 is a center Strike area 117 which credits 10 points to the player's score when impacted. Outside the center Strike area 117 are a number of impact zones 118, which are still within a typical Strike zone, but at the "corners". These impact zones carry differing point values which are added to the player's score upon impact, such as 70, 90 and 100 points. A number of "Balls" impact zones 119 are positioned outside of the Strike zone, with varying point values from 15 to 50 points. Any area outside the Ball impact zones 119 is considered to be a Wild Pitch which is awarded no point value for accuracy or speed.

Target Scan

FIG. 12 is an electrical schematic representing the X–Y matrix of the target board 62 connected to the target and processor assembly 54. The target and processor assembly 54 includes a CPU 120 interfaced with a row field programmable gate array or row FPGA 121 and a column FPGA 122. The CPU 120 can be an MC68HC16 microcontroller operating at 16 megahertz. The FPGA's 121 and 122 are programmable logic devices which are programmed at processor start-up to behave as a hard-wired logic circuit. The row FPGA 121 is programmed to respond to a 7 bit signal on a bus 123 to pull a designated row "low". Normally all rows and columns are "high". The rows are individually pulled to a logical low in a sequential scan by the CPU 120 and the row FPGA 121. As a thrown ball deflects the rows 65 into the columns 66 in the impact vicinity, as explained above, columns coming into contact with a row pulled low also will be pulled low. The column FPGA 122 sends an interrupt to the CPU 112 when any column goes low. The CPU 120 then asks the column FPGA 122 to send a 16 bit word to the CPU 120 over a 16 bit bus 124 indicating which one or ones of the columns, in the region of the current row scan, are low. Base (upon the rows being scanned and the columns pulled low by shorting with those rows, the CPU 120 develops a "geographic footprint" of the ball 36 striking the target board 62, which footprint can be used to represent a visual image of the impact force distribution or to determine the centroid or center of impact of the ball 36. The rows are scanned approximately 50,000 times per second, which means that, as the ball 36 impacts the screen, a number of such footprints are generated over time. Even when the speed of the CPU 120 is reduced by other simultaneous operations, such as error checking or a permanent short ignore sequence, a ball impacting the target at 100 miles per hour would still be scanned at least 20 times before it leaves the surface of the target board 62. If the ball is spinning, it will move across the screen in the direction of the spin and a time-derivative series of footprints can be used to detect and determine the direction and magnitude of spin. Thus, the pitch can be analyzed as a fastball, curve, slider, sinker, screwball, etc. depending upon whether the pitcher is right or left handed. In addition to adding interest and variety to a game format, this capability can be very valuable as a training aid for pitchers. A pitcher can readily determine both the accuracy and effectiveness of particular pitches based upon impact location and detected spin characteristics.

Speed Detection

Figure 2:
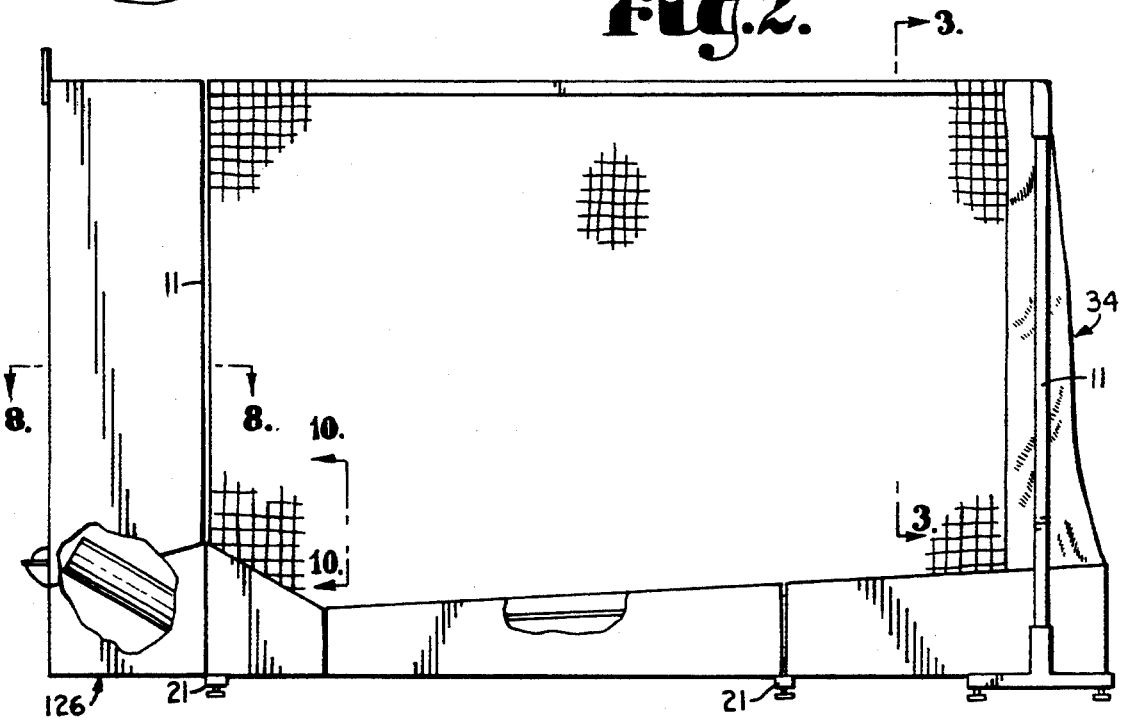
FIG. 2 is a side elevational view of the baseball pitcher's game and training apparatus.
Figure 10:
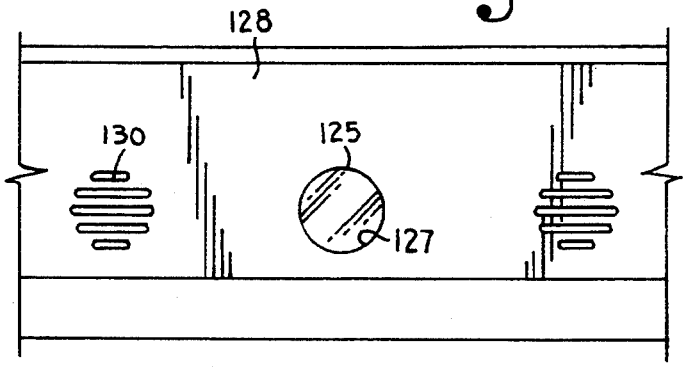
FIG. 10 is an enlarged, fragmentary cross-sectional view of the radar gun and speakers, taken along line 10—10 of FIG. 2.

Referring to FIGS. 2 and 10, a radar gun 125 is mounted in a player control station 126 with the gun 125 aimed through an aperture 127 in a rear panel 128. The radar gun 125 directs a broad radar beam through the flight path of a ball thrown at the target board 62 and determines the speed of an obstacle, such as a thrown ball, moving through the radar beam. The radar gun 125 uses conventional Doppler speed measurement techniques. The radar gun 125 then sends a digital signal representative of the ball speed to the game computer 95. Alternatively, other types of speed sensing devices could be employed, such as ultrasonic devices, optical timing devices, and the like. A pair of speakers 130 are mounted, one on each side of the radar gun 125.

Player Scoreboard and Control Panel

Figure 8:
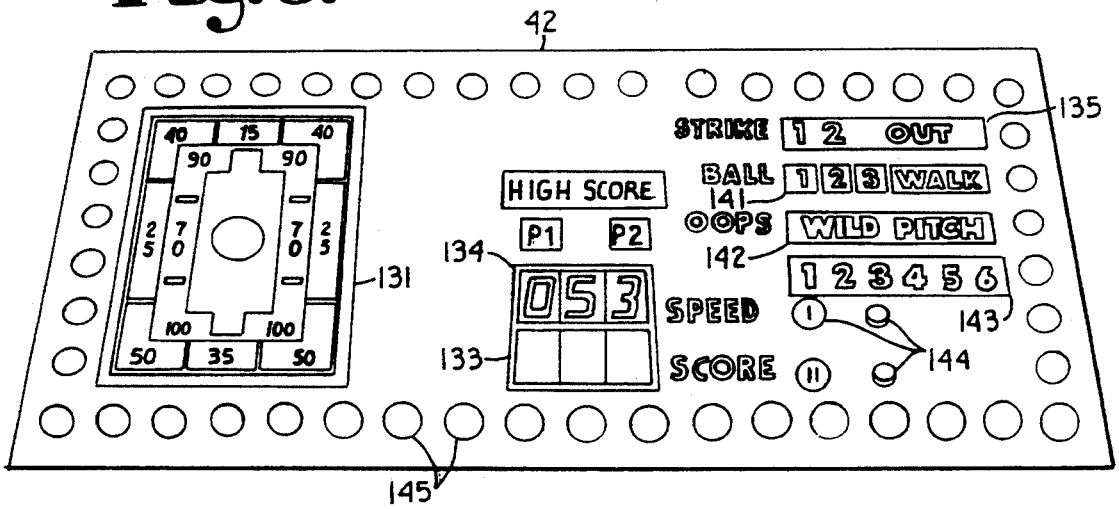
FIG. 8 is an enlarged, cross-sectional view of a control and display panel for the baseball pitcher's game and training apparatus, taken along line 8—8 of FIG. 2 and illustrating one arrangement of lighted indicators, score and speed displays and control buttons.

FIG. 8 illustrates the player scoreboard and control panel 42 which is positioned in the top of the player control station 126 and is slanted to face the player 35. At the left side of the panel 42 is a representation of the target face 131 with the point impact zones recreated. A number of individual display lamps 132 (FIG. 9) are positioned, one beneath each zone to indicate the zone hit by the ball 36, and one beneath each of several indicating windows, as described below. In the center of the panel 42 is a digital score readout 133 and a speed readout 134. The game computer 95 controls the speed readout to indicate the speed of each thrown ball 36, as sensed by the radar gun 125. This speed readout is then "melted." into the score readout by decrementing the speed readout 134 as the score readout 133 is incremented. At the top right of the panel 42 are a lighted Strike indicator 135, a Ball indicator 141, a Wild Pitch indicator 142 and a pitch number indicator 143. Each of these indicators keeps a tally of the current game status. At the bottom right of the panel 42 are a number of control buttons 144, which can include a one player selector, a two player selector, a combination extra ball and special event button which is operative to cause a special event announcement to be generated if play has not started, or, if play has commenced, to obtain an extra ball if a ball should be inadvertently dropped or thrown so poorly that it does not register even as a Wild Pitch. In addition, one of the buttons 144 can toggle between "Normal play" and "Trainer coach" modes, as explained below. A number of "chaser lamps" 145 are positioned about the periphery of the panel 42. Positioned beneath the control panel 42 are a coin and bill acceptor 146, a coin return 147, and a reward dispenser 148. Rewards can be baseball cards, tickets for prizes in an arcade, etc.

Figure 9:
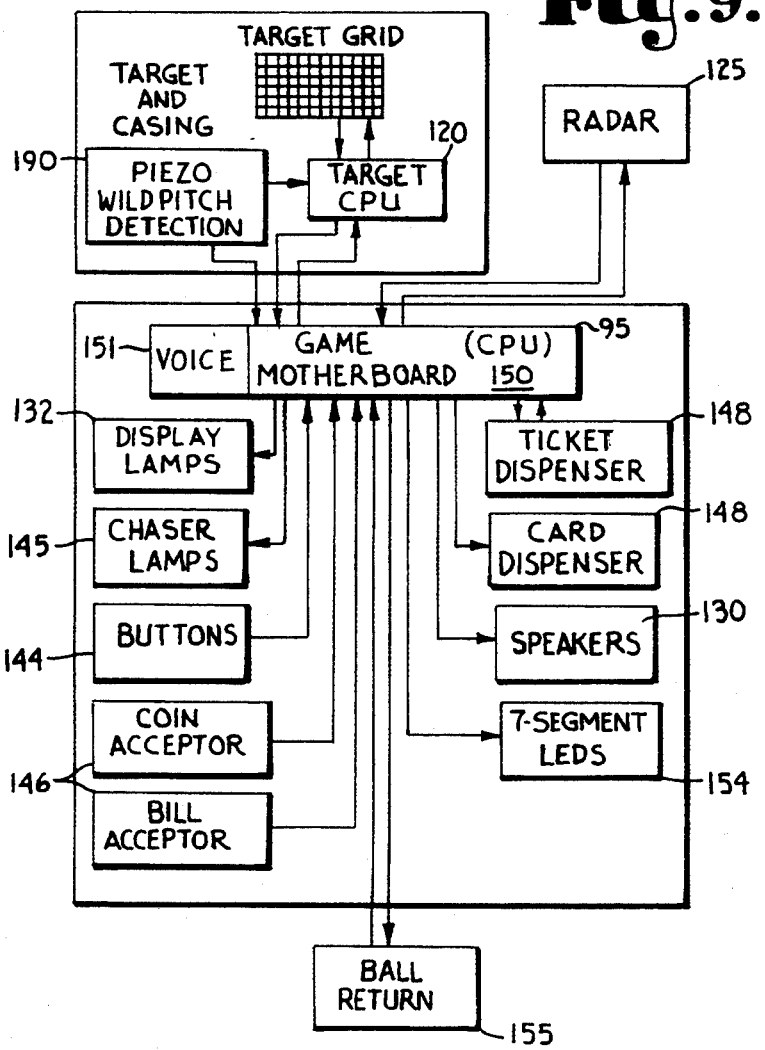
FIG. 9 is a block electrical diagram illustrating the game CPU and the interconnections between it and all of the peripheral devices.

FIG. 9 is a block schematic diagram of the game computer 95 connected to each of the peripheral devices. As is illustrated, the computer 95 includes a CPU 150 connected to a digital voice storage module 151 which is capable of storing up to 14 minutes of verbal messages. The verbal messages are selectively sent to the speakers 130 to provide an interactive commentary for the player 35. The CPU 150 also controls the plurality of display lamps 132 for indicating Strike and Ball count, hit target zone, etc. and the chaser lamps 145. The coin and bill acceptor 146, the reward dispenser 148, and a plurality of seven-segment LED's 154 for tallying speed and score are also controlled by the CPU 150. In addition, the target processor CPU 120, the radar gun 125, and a ball return 155 are also interactively controlled by the CPU 150.

Ball Return

Figure 13:
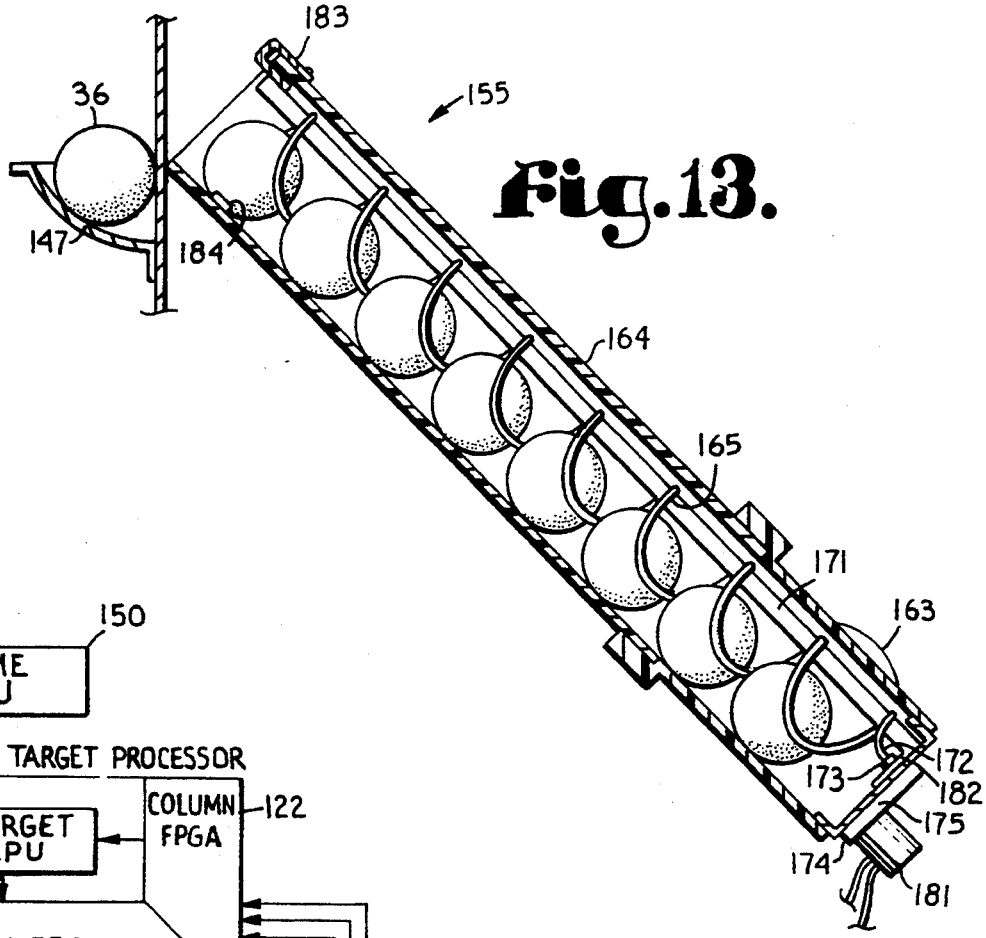
FIG. 13 is a perspective view of a ball return apparatus illustrating the drive which selectively returns balls to the player.
Figure 14:
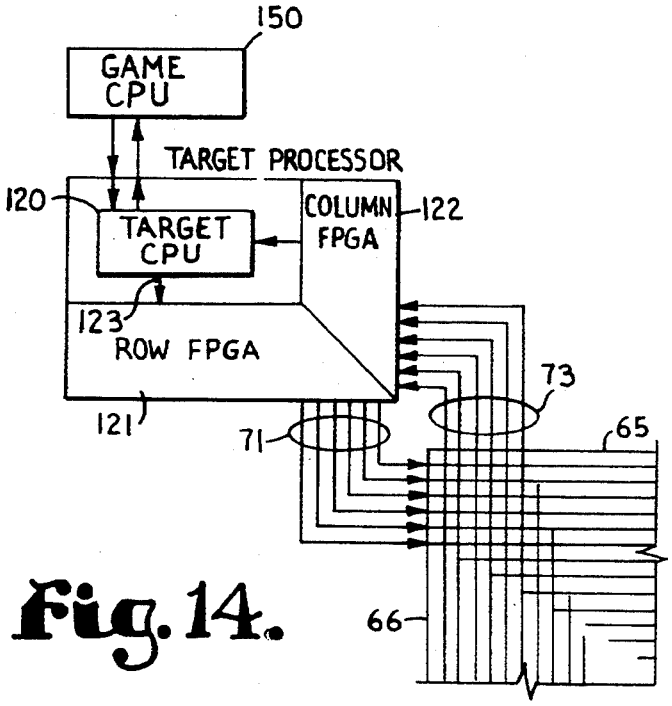
FIG. 14 is a side plan view of the ball return apparatus illustrating the relative sizes between the return tube, the drive spring and the balls as well as details of the motor drive.

FIGS. 2, 12 and 13 illustrate the ball return 155. As balls 41 roll down the incline of the ramp 31, they enter a ball receptacle tray 161 which is formed with a recess 162 which directs the balls 41 into an inlet elbow 163 which is attached to an angled delivery tube 164.. Within the tube 164 a spiral spring member 165 extends around a longitudinal keeper 171. A bottom end 172 of the spring 165 is inserted into a drive socket 173. The drive socket 173 is connected through a motor support plate 174 to a gear assembly 175 which is driven by an electric motor 181. The keeper 171, at the bottom end thereof, is attached to a ring 182 surrounding the drive socket 173, with the ring 182 being rotatable relative to the drive socket 173. The top end of the keeper 171 is attached to a C shaped clamp 183 which extends over the top lip of the tube 164 to hold the keeper 171 and the spring 165 in position. The drive socket 173, and thus the spring 165, are mounted on the motor support plate 174 in a position in which they are eccentric with respect to the tube 164. The spring 165 is coated with Teflon or a similar low friction material to minimize wear on the balls 36 as they move through the tube 164. The tube 164 and the inlet elbow 163 can be constructed of standard 4" PVC pipe, for example. The balls 36 typically have a diameter of approximately 3" while the diameter of the spring 165 is approximately 2.5 inches. The spring 165 and keeper 171 are angularly spaced from the inlet elbow by approximately 90 degrees to permit the balls 41 to readily enter the bottom of the tube 164 without interference from the rotating spring 165. A ball sensing switch 184 is positioned near the top of the tube 164 to detect the presence of a ball 36 in the topmost spiral of the spring 165. The motor 181 will be operated continuously until the ball switch senses the presence of a ball 36 in this position, and then selectively operated to deliver the ball 36, as explained below.

When the game CPU 150 determines that a ball 36 is to be delivered to the player 35, and provided that the switch 184 senses the presence of a ball 36 in the topmost spring spiral, the motor 181 is turned on for a time sufficient to rotate the spring 165 through one revolution. Preferably the gear assembly 175 and the motor 181 are designed to rotate the spring 165 at a speed of about 15 RPM. As the spring 165 turns through one complete revolution, the balls 41 in the tube 164 are urged upward for a distance which is enough to drive a top ball 36 out of the tube 164 and into a ball holder 185. The ball return 155 is so reliable that it was continuously operated for one week without jamming or otherwise failing, with about 9000 balls per hour cycling through the tube 164.

Wild Pitch Sensing

Referring again to FIG. 9, a piezo-electric sensor 190 is incorporated into the target board 62 to detect any vibration of the board 62 or the target receptacle 44. In the event that the player 35 throws a ball 36 which impacts the periphery of the target board 62, but does not trigger the sensing matrix, or, alternatively, strikes the target receptacle 44 outside of the board 62, the piezo sensor 190 will be triggered, even when no impact area is sensed by the target processor CPU 120. Thus, a Wild Pitch can readily be determined by the triggering of the piezo sensor 190 in the absence of an impact sensing by the target processor CPU 120. The radar gun 125 can also be used to determine a Wild Pitch by the existence of a target projectile in the radar beam with no corresponding readout from the target CPU 120. The piezo sensor 120 and the radar gun 125 can be separately used for this Wild Pitch determination or jointly used as a cross check against each other.

Logic Flowcharts

Figure 15:
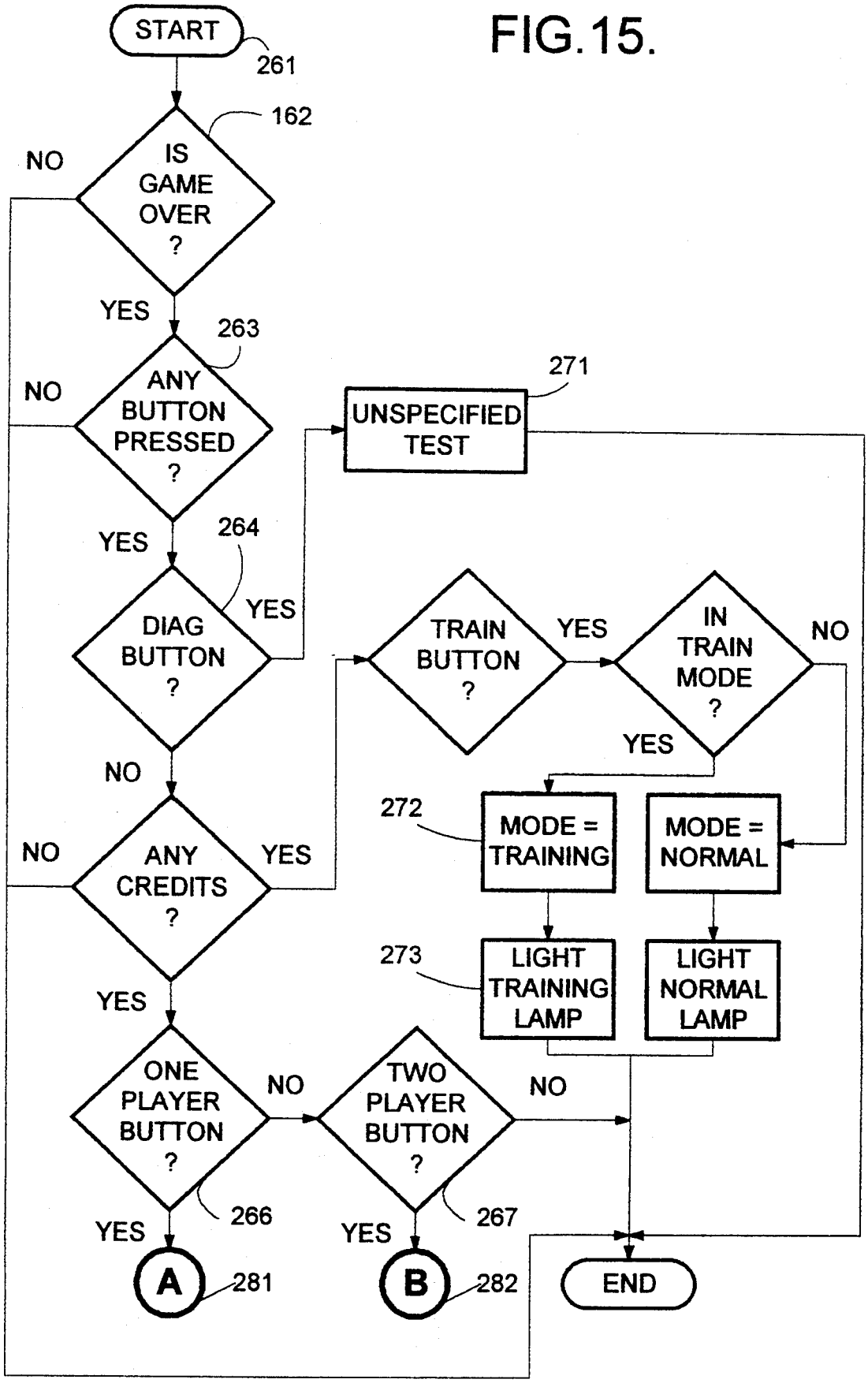
FIGS. 15 and 16 are flow diagrams .illustrating portions of attract mode routines of the software of the baseball pitcher game and training apparatus.
Figure 16:
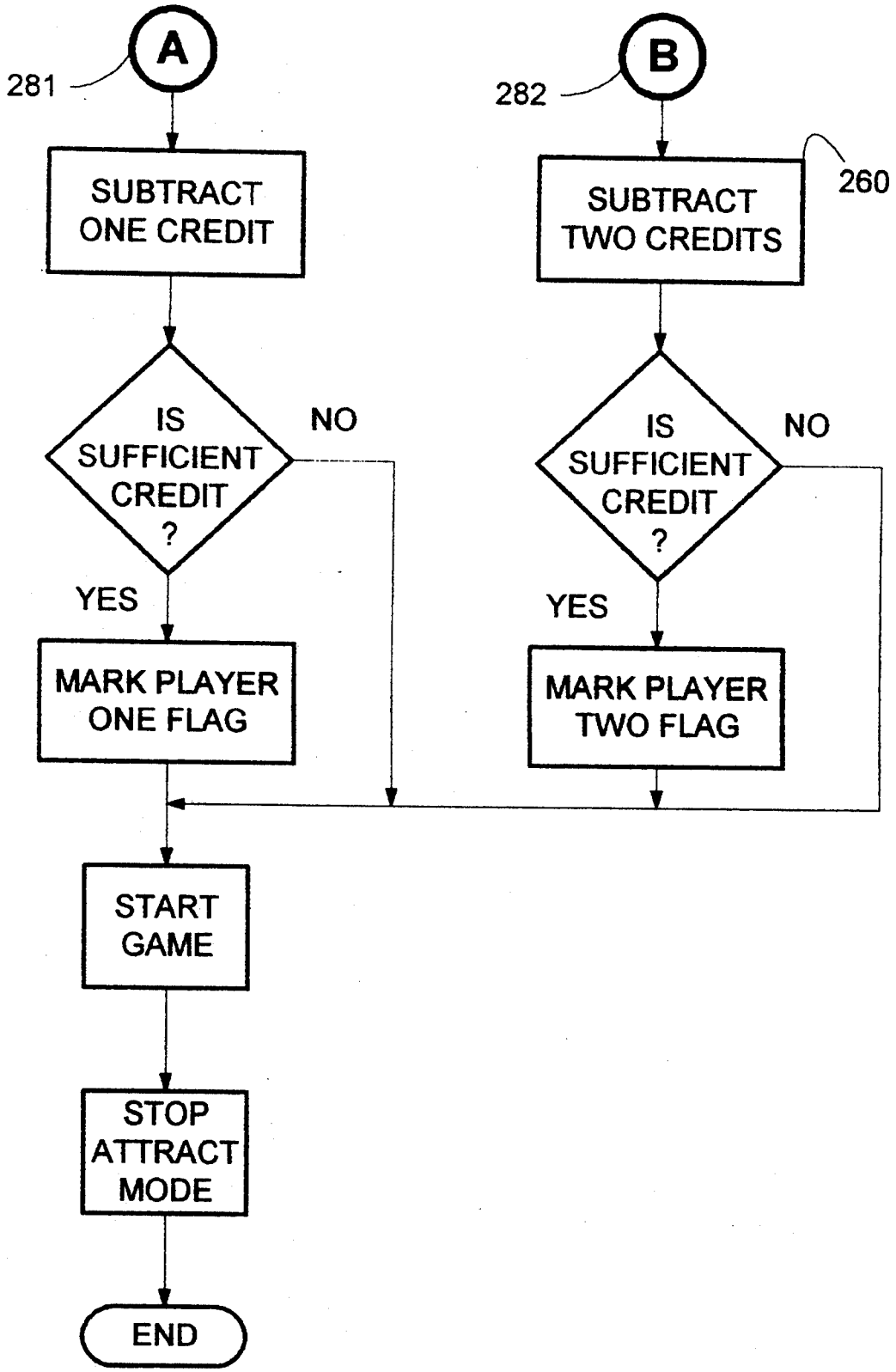

FIGS. 15 and 16 illustrate a logic flowchart of the game CPU 150 software for a player attract routine 260. The program is started upon power-up at block 261 and questions whether a game is in progress at block 262. If no game is in progress, at block 263 the CPU 150 looks for any depressed control buttons 144. If control buttons are pressed, blocks 264, 265, 266 and 267 sequentially ask which button. If a diagnostic button is depressed, any diagnostic tests are run at block 271. If the train button is depressed, the game is put in training mode at block 272, and a train lamp is activated at 273. If one or two player buttons are depressed, the one or two player modes, respectively, are entered at blocks 281 and 282 which are also shown in FIG. 16. At block 289, the main game routine 290 is entered.

Figure 17:
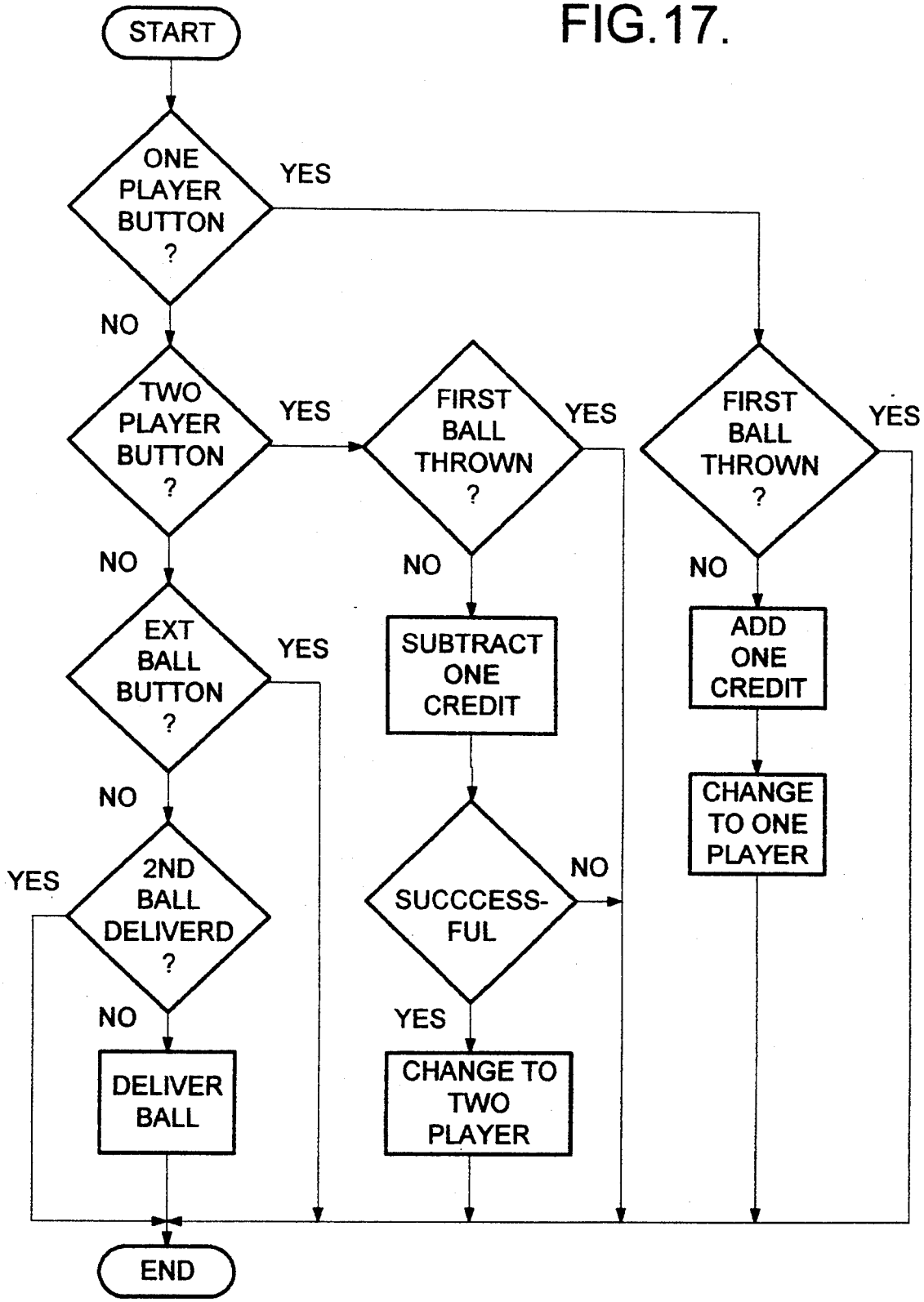
FIG. 17 is a flow diagram illustrating a main game routine of the software of the baseball apparatus.

FIG. 17 is a logic flowchart of the game CPU 150 software during the main game routine 290. At decision blocks 291 and 292, the CPU 150 looks for the one or two player buttons to be activated. At blocks 293 and 294, the selected game mode is entered provided no balls have been thrown. At blocks 301–303, an extra ball is selectively provided after a wild pitch is thrown. At block 304, the CPU enters the interrupt mode.

Figure 19:
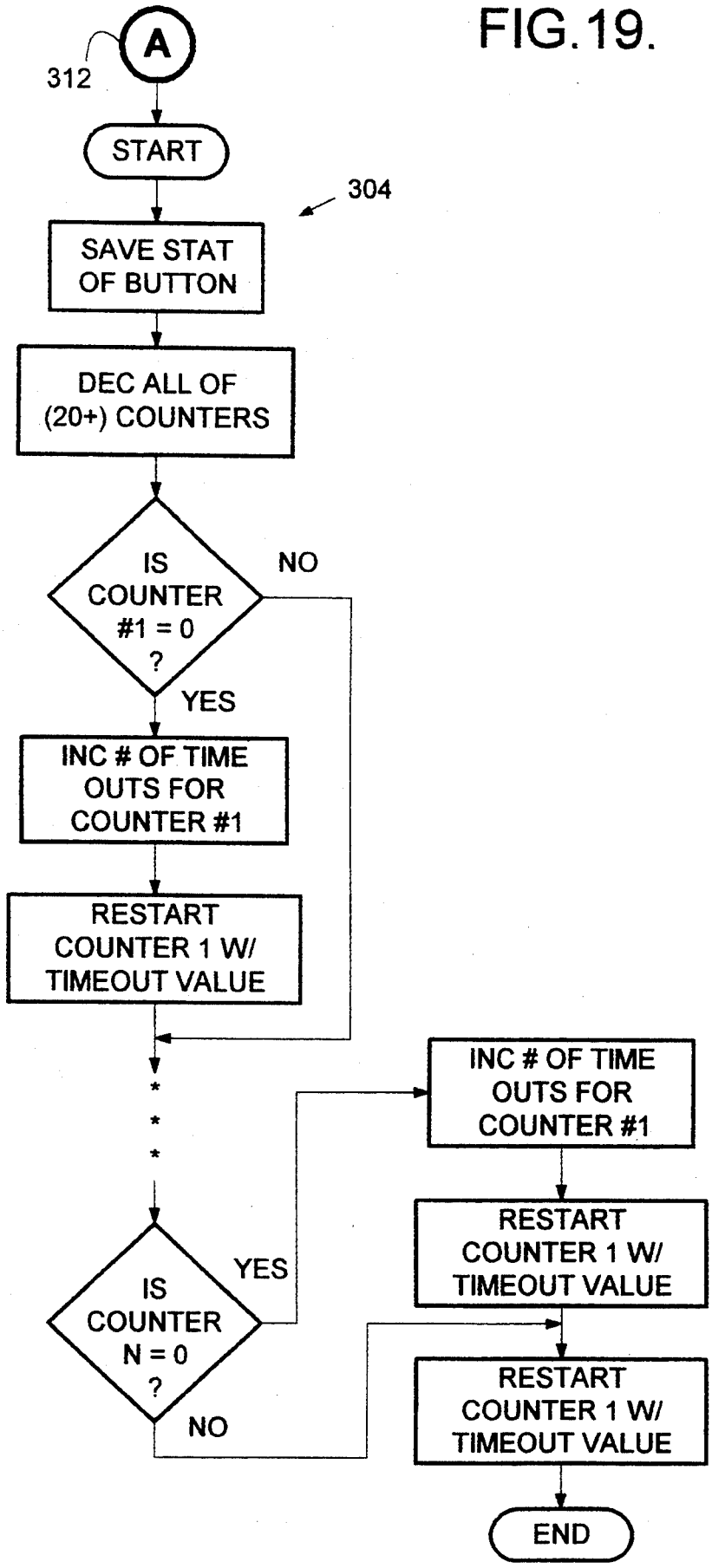

FIGS. 18 and 19 are a logic flowchart of the game CPU 150 software interrupt handling routine 304. At block 305, an interrupt is detected and the query is whether the interrupt was generated by the serial port.

At blocks 306 and 307 respectively, the CPU 150 checks whether the target has sent the interrupt, and, if not, whether it was data from the radar gun. For a positive response at block 306, a target routine is implemented, and for block 307 a speed, radar, and wild pitch routine is implemented. If the interrupt was not from the serial port, the buttons are queried at block 311 and an affirmative answer causes a button determination routine to be implemented. If the interrupt is not from a button, a time-out sequence is started at 312, as detailed in FIG. 19.

Figure 20:
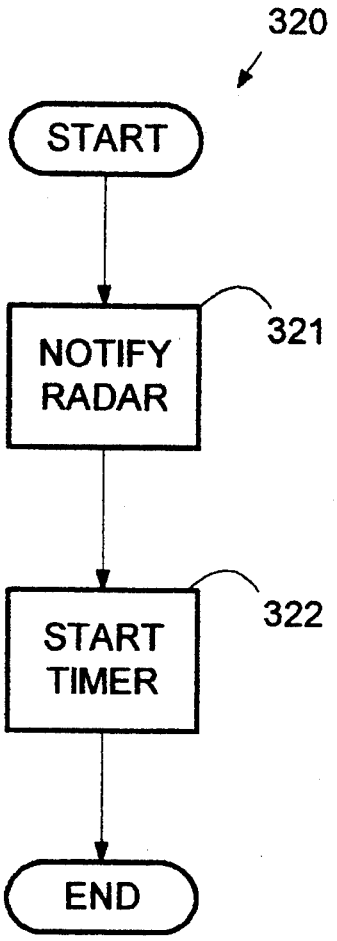
FIG. 20 is a flow diagram illustrating a wild pitch detection routine of the software of the baseball apparatus.
Figure 21:
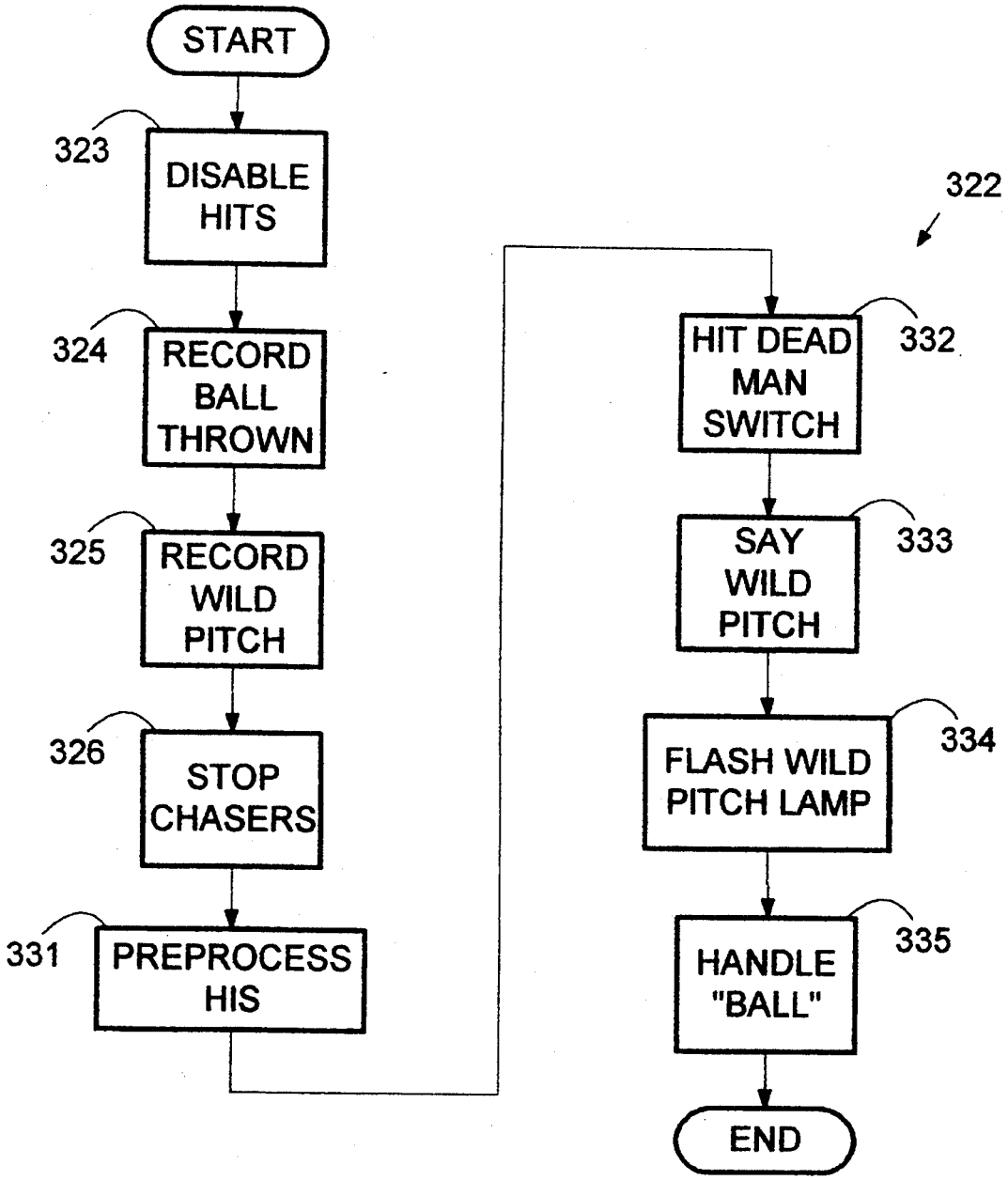
FIG. 21 is a flow diagram illustrating a wild pitch timer routine of the software of the baseball apparatus.

FIG. 20 is a logic flowchart of the game CPU 150 software wild pitch detection routine 320, and FIG. 21 shows the implementation of a wild pitch timer routine. At block 321 FIG. 20, the radar gun 125 is initiated to look for a pitch, and at block 322 the wild pitch timer is started. After the timer expires, the hit interrupt is disabled at block 323 FIG. 21, a ball is recorded as thrown at block 324, a wild pitch is recorded at block 325, and the chaser lamps are stopped at block 326. At block 331, a preprocess hit routine is enabled for entry, if needed, as will be detailed below; at block 332 a hit dead man switch is activated; and at block 333 the voice module 151 is accessed to announce "wild pitch". The dead man switch routine (not shown) operates a timer which is restarred whenever any of the buttons 144 are operated or a wild pitch is detected. If the dead man timer expires, a voice message is activated to urge the player to throw a ball. At block 334 the wild pitch lamp 142 is lit; and at block 335 the handle "Balls" routine is implemented, since a wild throw is counted as a Ball.

Figure 22:
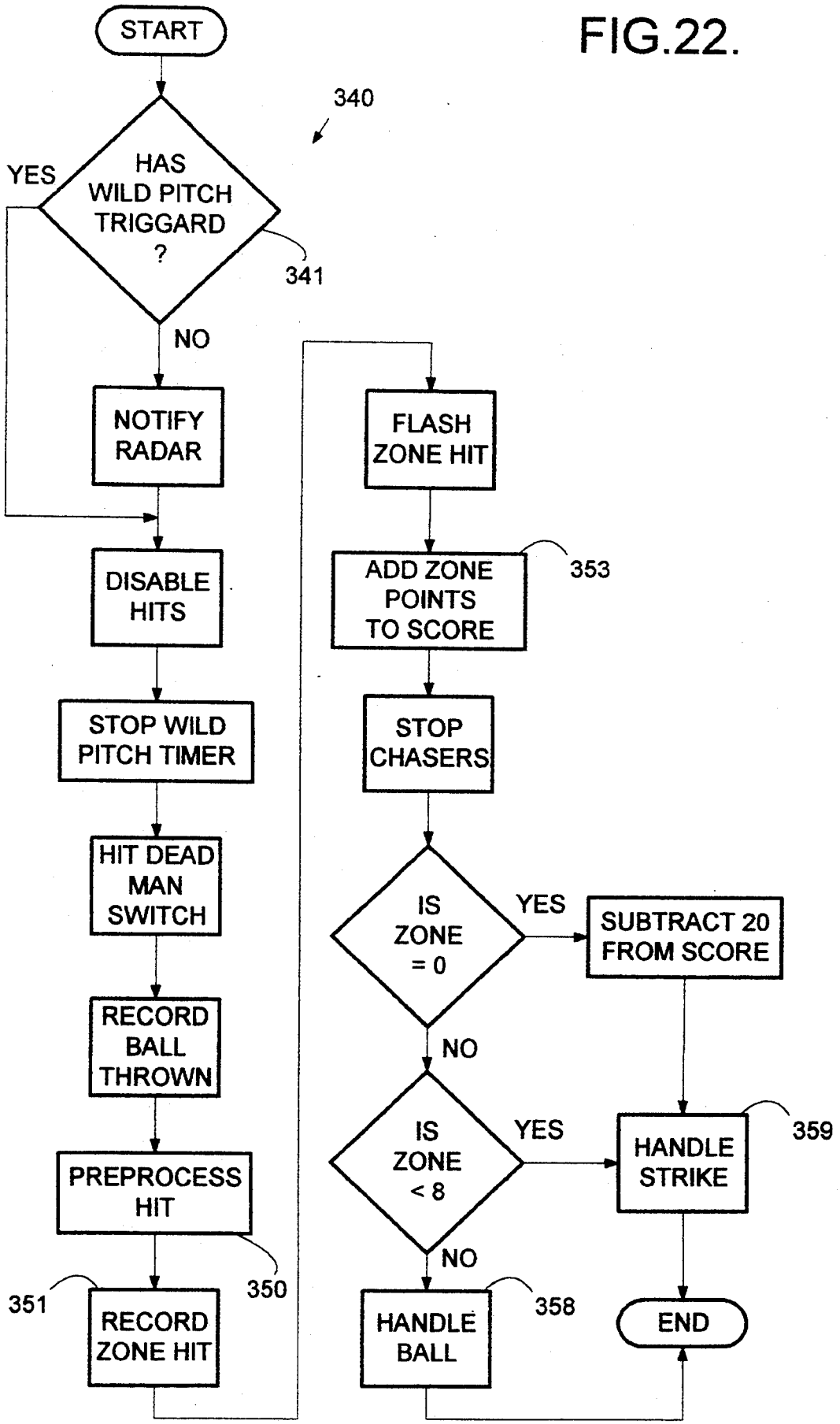
FIG. 22 is a flow diagram illustrating a hit logic routine of the software of the baseball apparatus.

FIG. 22 is a logic flowchart of the game CPU 150 implementing a hit logic routine 340. Once a hit has been detected, at block 341 a wild pitch query is initiated. If it is positive, the wild pitch hit routine 320 is initiated, bypassing the speed scoring. If it is not a wild pitch, a hit processing routine is implemented to enable the hit preprocessor routine at 350 and to record the zone hit at 351 and the zone score at 353, to flash the appropriate lamps, and to tallying of Ball or Strike, via Handle Ball or Handle Strike routines 358 and 359 respectively.

Figure 23:
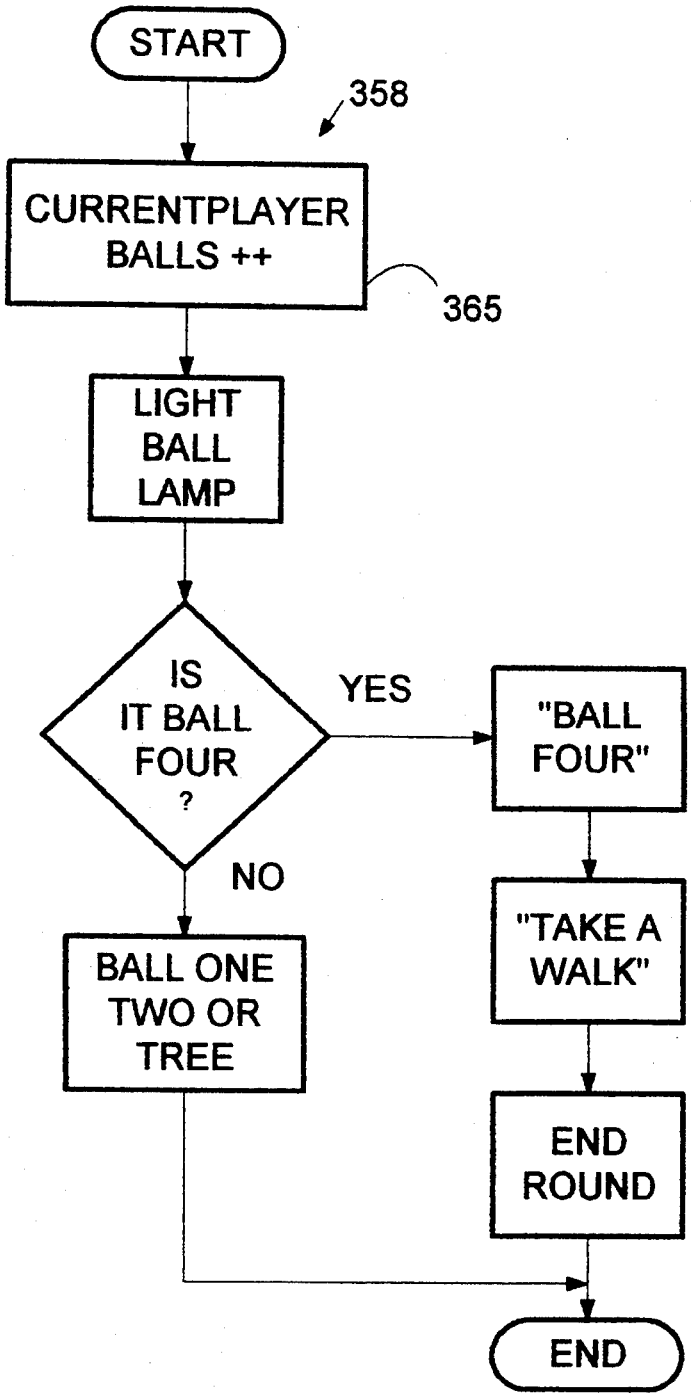
FIG. 23 is a flow diagram illustrating a "handle ball" routine of the software of the baseball apparatus.
Figure 24:
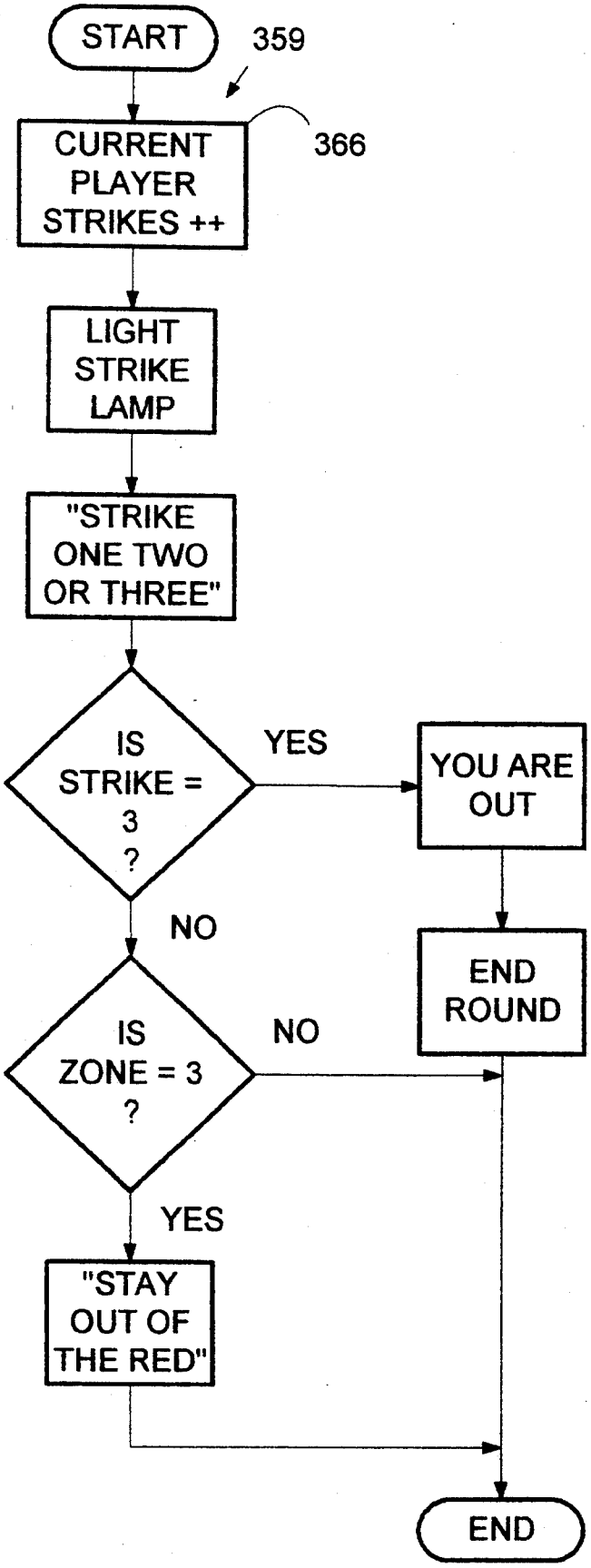
FIG. 24 is a flow diagram illustrating a "handle strike" routine of the software of the baseball apparatus.

In FIGS. 23 and 24 respectively, the Handle Ball routine 358 and the Handle Strike routine 359 of the game CPU 150 are illustrated. Each routine first determines the respective numbers of Balls and Strikes, at blocks 365, FIG. 23 and 366, FIG. 24 respectively, and, if the number of Balls is four or the number of Strikes is three, implements appropriate announcements and ends the current round. Otherwise the correct Ball or Strike count is announced and displayed.

Figure 25:
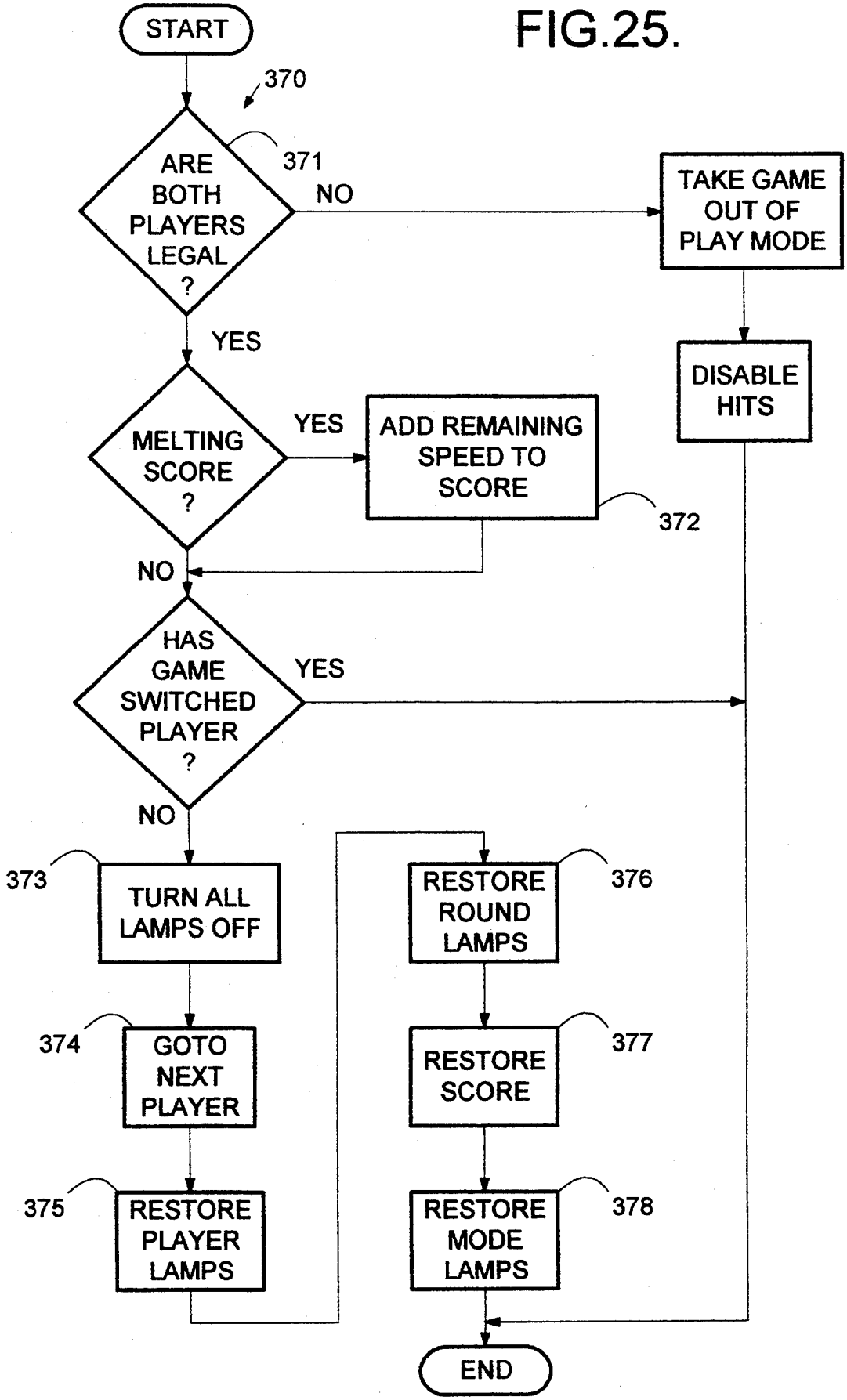
FIG. 25 is a flow diagram illustrating a preprocess hit routine of the software of the baseball apparatus.

FIG. 25 is a logic flowchart of the game CPU 150 software Preprocess Hit routine 370, shown as block 331 in FIG. 21 and block 350 in FIG. 22. At block 371, the players are checked to see if they are legal, and, if not, the game is disabled. The preprocess hit routine 370 is provided to accomplish a quick finish to a previous player's turn if the next player throws a hit before normal processing of a turn is complete. In general, the score is quickly updated at 372 instead of melting the speed points into the hit points, and the lamps on the scoreboard and control panel 42 are updated at blocks 373–378.

Figure 26:
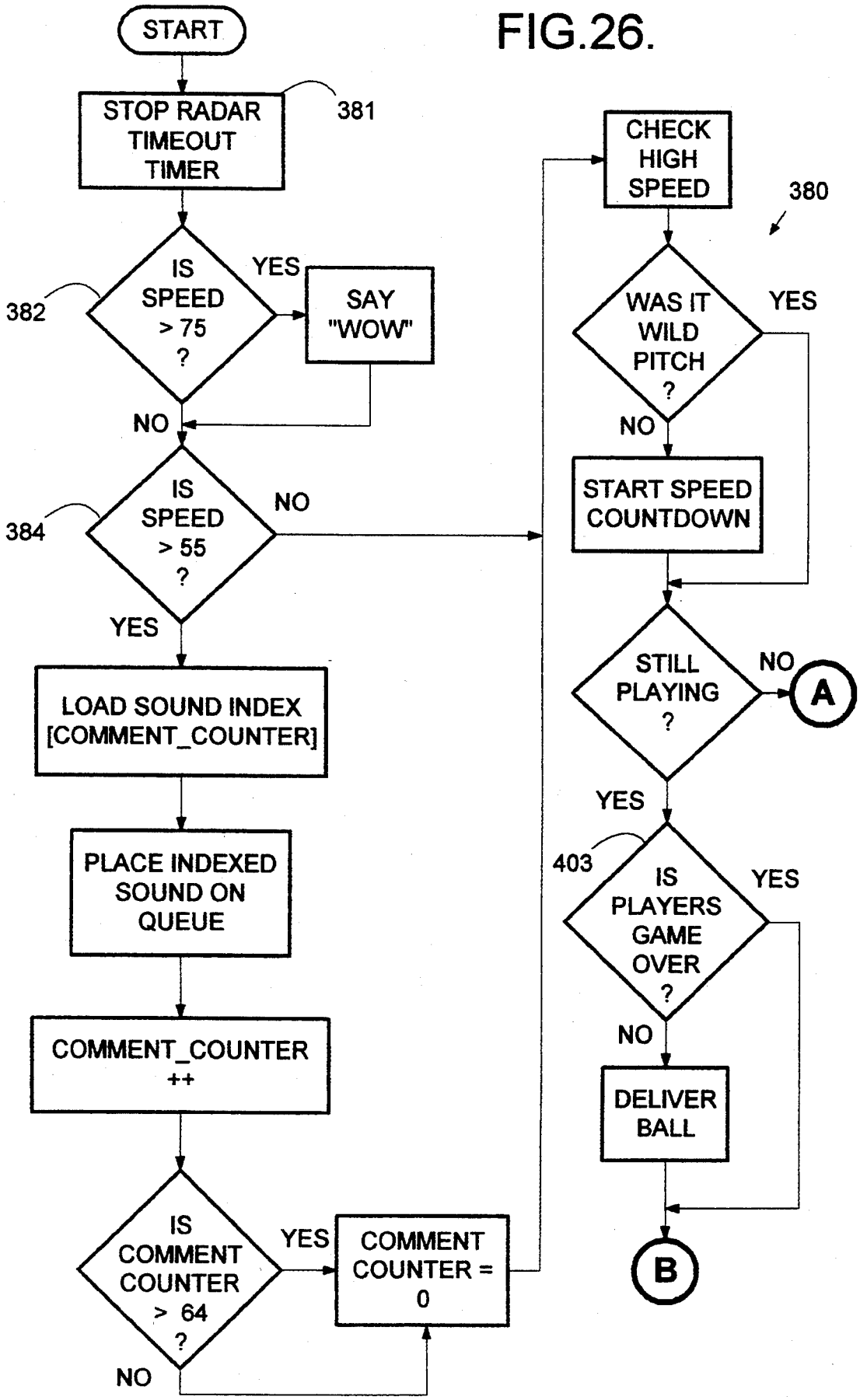
FIGS. 26 and 27 are flow diagrams illustrating portions of a radar reading routine of the software of the baseball apparatus.
Figure 27:
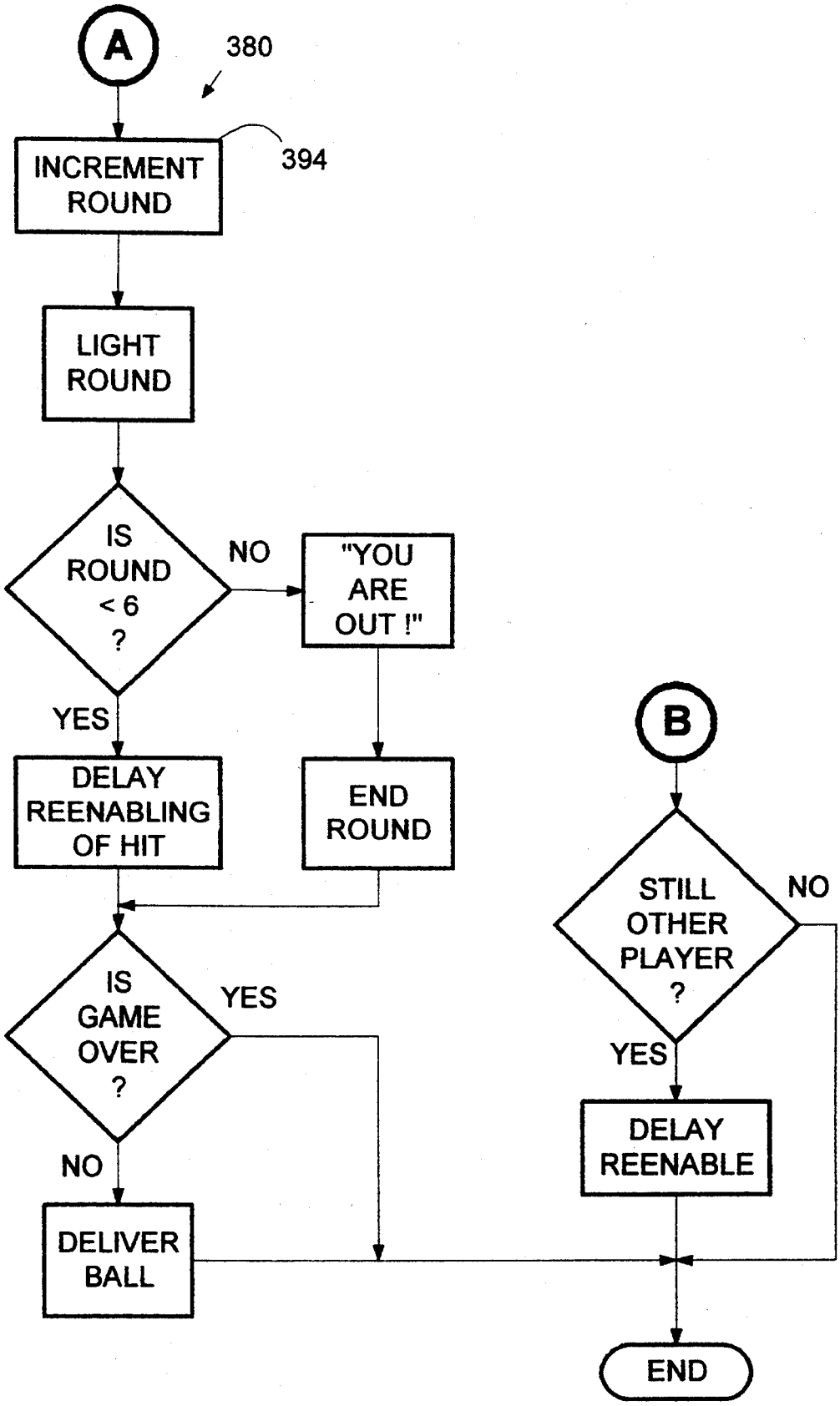

FIGS. 26 and 27 are portions of a logic flowchart of the game CPU 150 software Radar reading routine 380. After a radar interrupt, the radar reading routine 380 is started by stopping a radar timeout timer at block 381. At block 382, a speed decision block is implemented with a comment if the speed is greater than 75 MPH. Then, at block 384, if the speed is greater than 55 MPH, a comment series is implemented, and, in either case, a speed count is implemented if the throw was not a wild pitch. Next a round increment branch beginning at block 394 in FIG. 27 or an end of game determination routine at block 403 in FIG. 26 is implemented with appropriate verbal comments generated.

Figure 28:
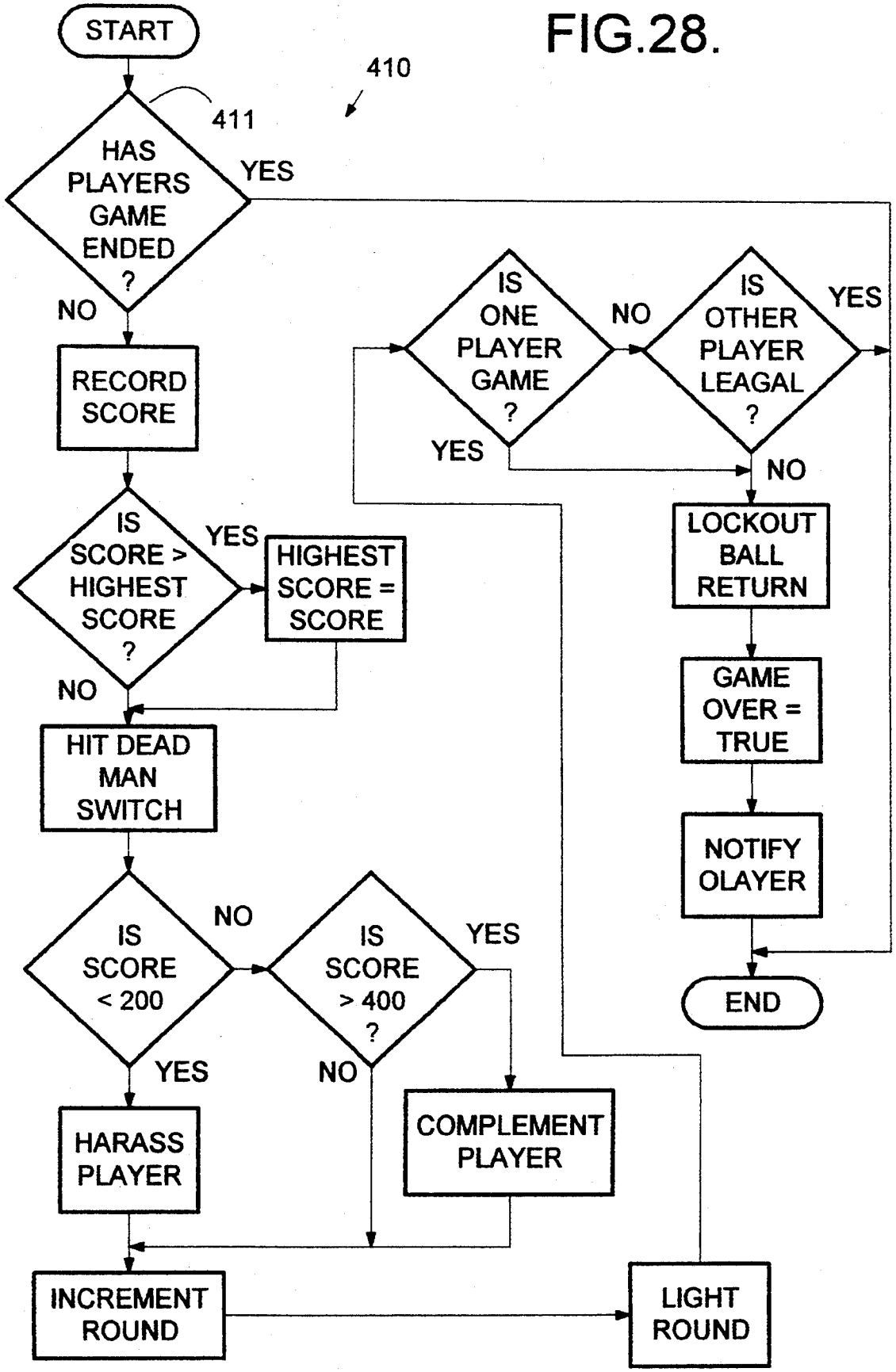
FIG. 28 is a flow diagram illustrating an end round routine of the software of the baseball apparatus.

FIG. 28 is a logic flowchart of the game CPU 150 software for round ending routine 410. At block 411, a game end determination is made, and, if the answer is no, the player's high score is incremented if warranted, and appropriate compliments or harassing comments are generated, the ball return 155 is locked out or the next player's turn is enabled.

Figure 29:
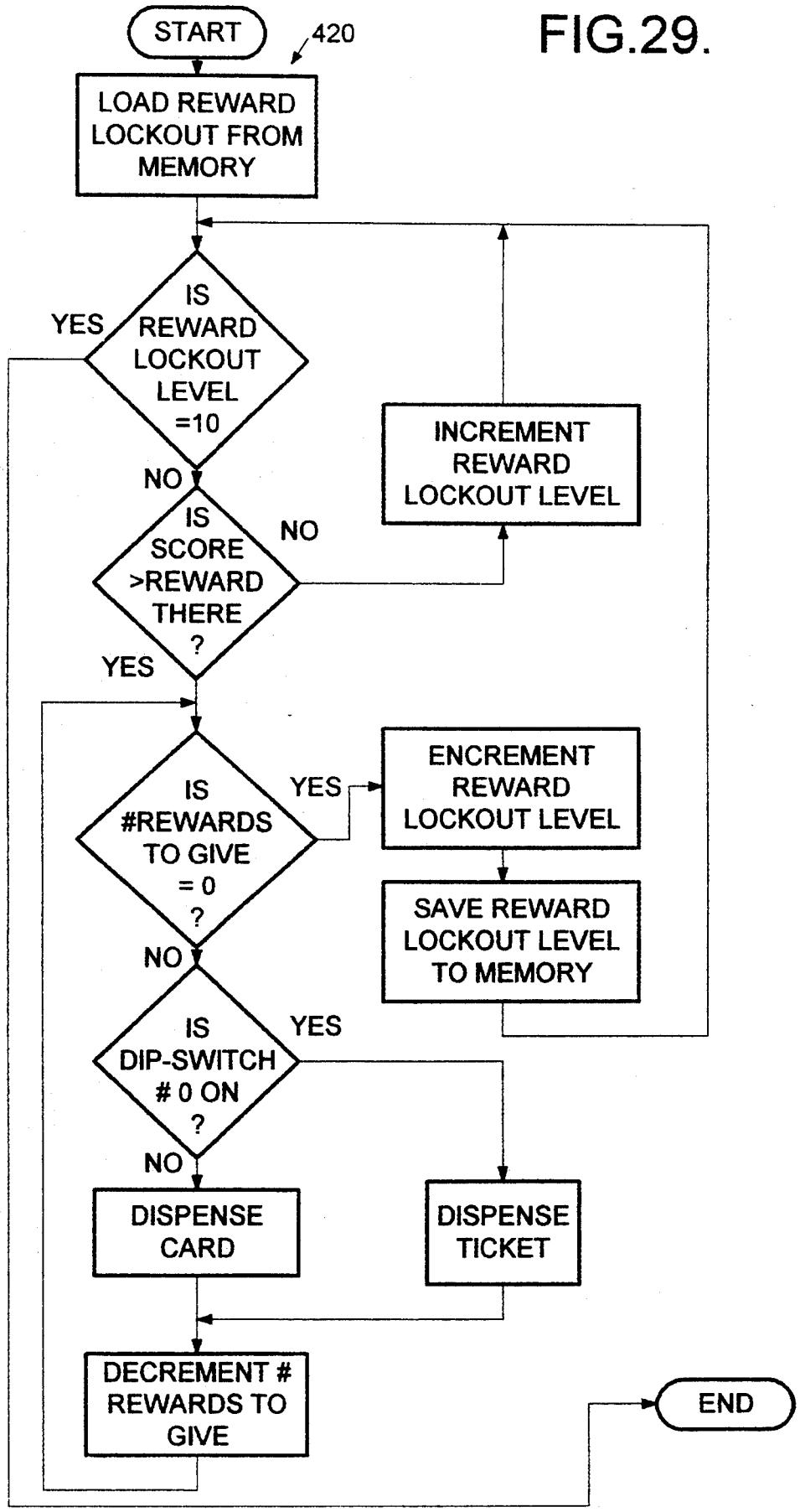
FIG. 29 is a flow diagram illustrating a reward determination routine of the software of the baseball apparatus.

FIG. 29 is a logic flowchart of the game CPU 150 software reward determining routine. The game apparatus 1 can be programmed to dispense reward cards or tickets through the dispensers 148 based on various ranges of scores of the player or players. The rewards routine 420 controls operation of the dispensers 148, based on the score obtained, to dispense discount coupon tickets, baseball cards, or the like.

Figure 30:
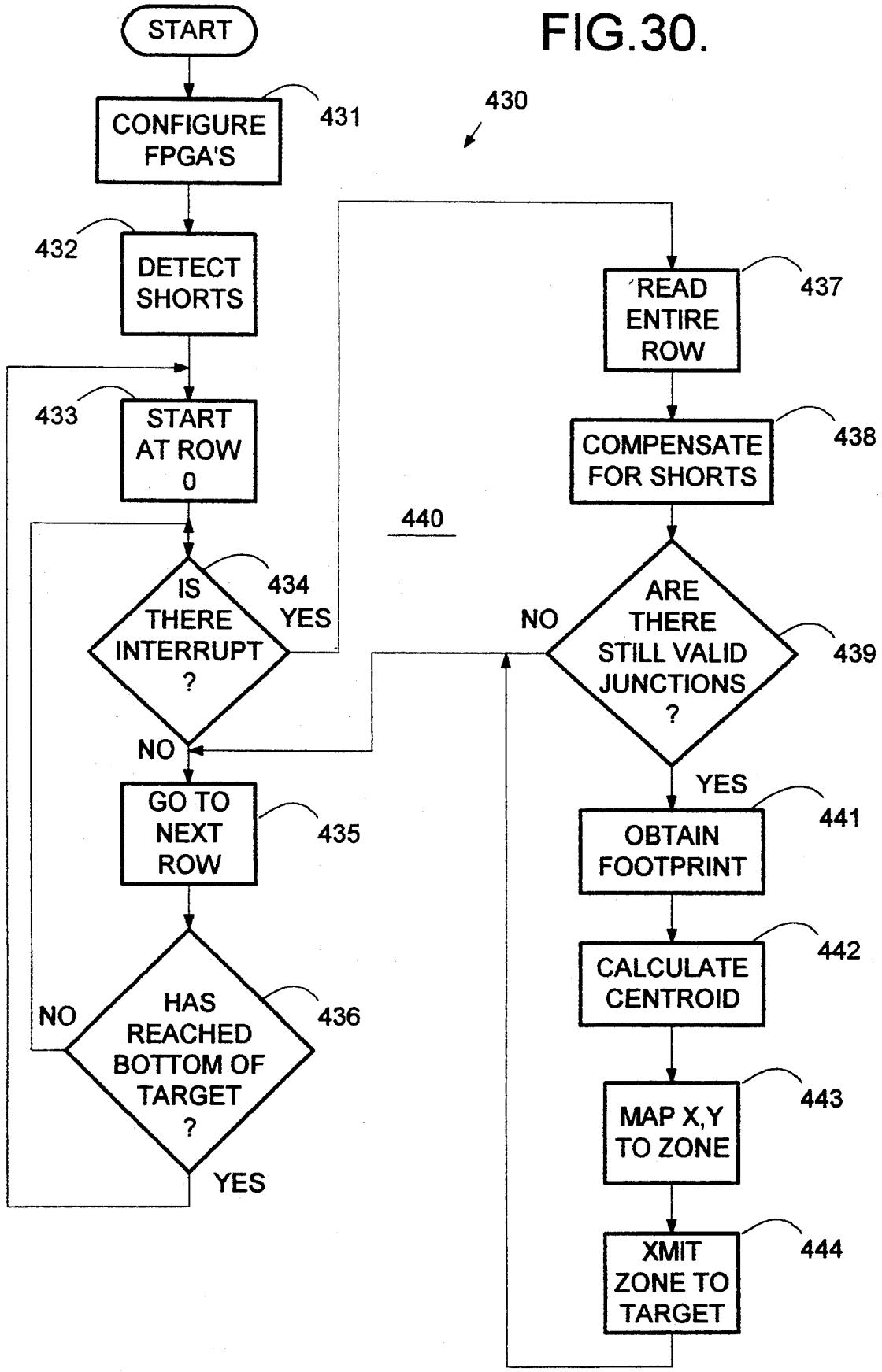
FIG. 30 is a flow diagram illustrating a main target routine of the target CPU of the baseball apparatus.
Figure 31:
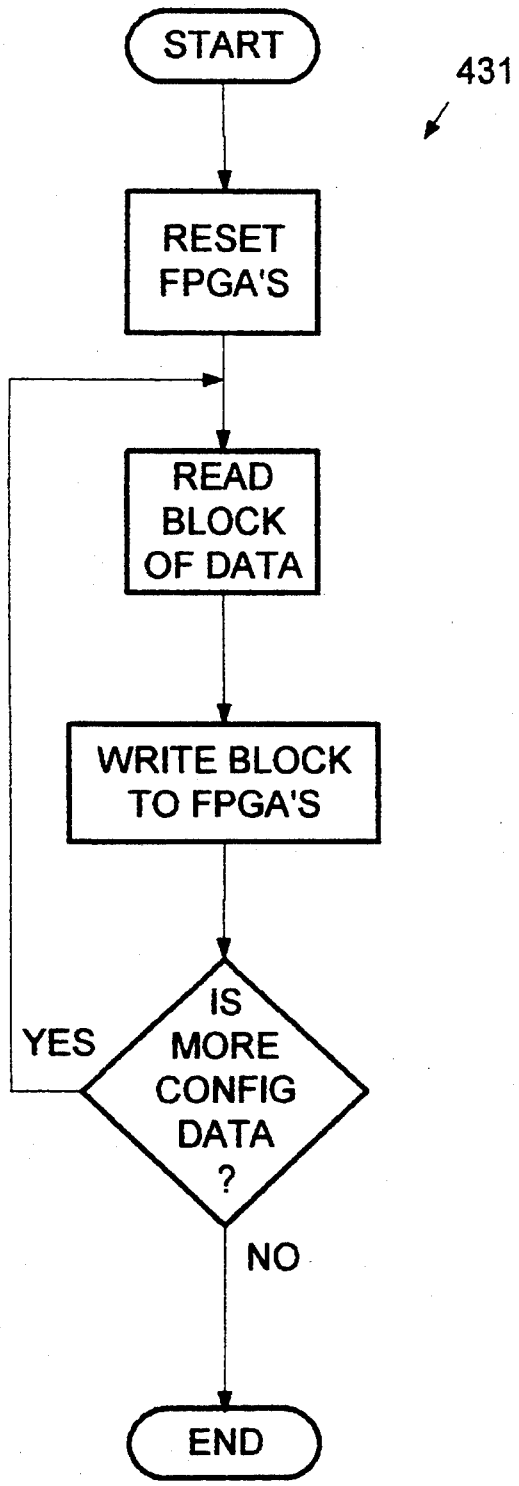
FIG. 31 is a flow diagram illustrating an FPGA configuration routine of the target CPU of the baseball apparatus.

FIG. 30 illustrates a main target routine 430 executed by the target CPU or processor 120. Upon powerup, the target CPU 120 configures the FPGA's 121 and 122 at block 431, then scans the rows 65 and columns 66 to detect short circuits at block 432. Details of the FPGA configuration routine 431 are shown in FIG. 31. Blocks 433–439 comprise a target scanning loop 440, including a shorts compensation routine 438 for compensating for the existence of short circuits between the row lines 65 and the column lines 66. At block 441, a footprint of the impact of the ball 36 with the target and processor assembly 54 is obtained. The centroid of the footprint is calculated at block 442. At block 443, the X and Y coordinates of the impact centroid are mapped to a particular target zone 116–119 of the target face 55. In block 444, the mapped target zone 116–119 is transferred to the main processor 150 to cause illumination of a corresponding area of the target display 131 of the scoreboard 42.

Figure 32:
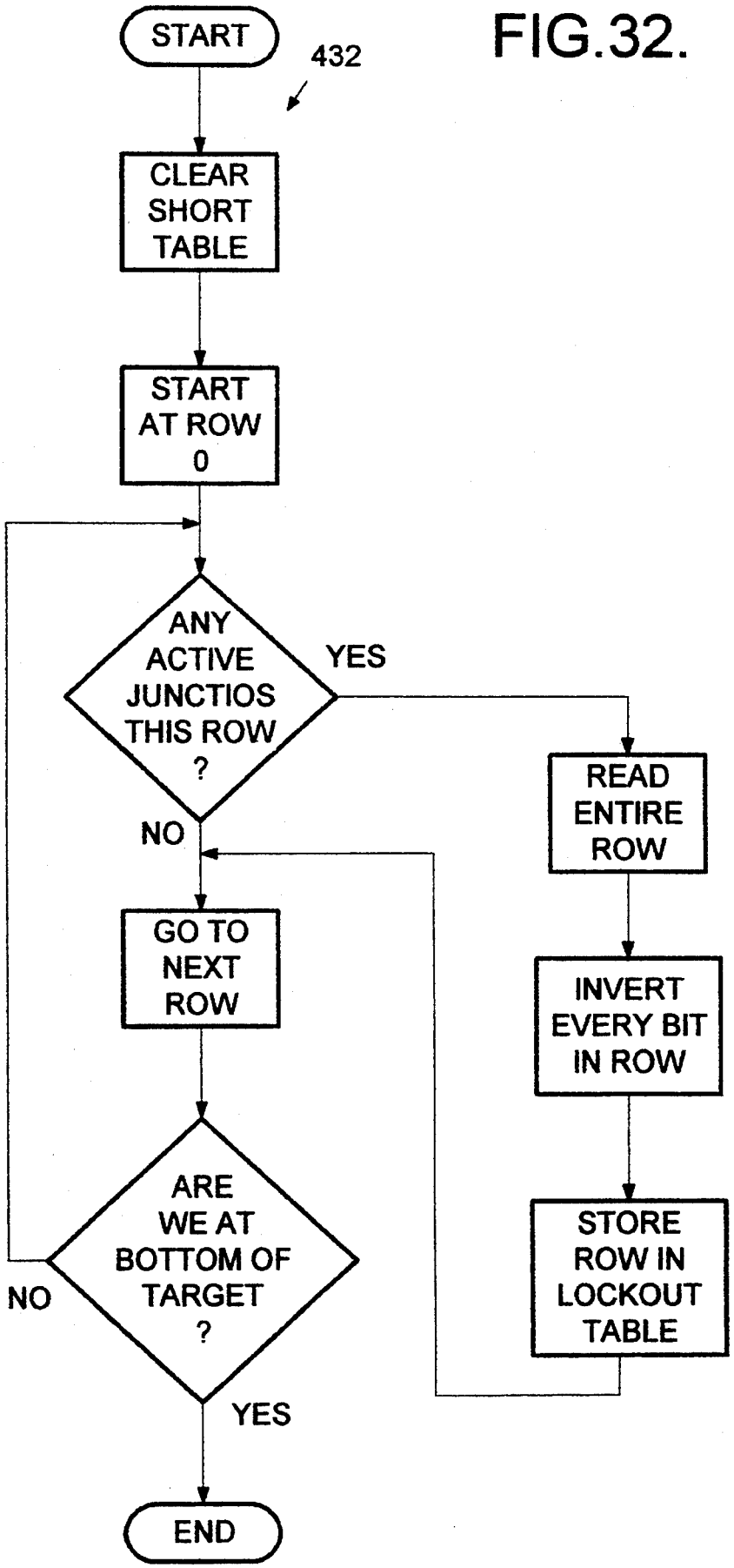
FIG. 32 is a flow diagram illustrating a shorts detection routine of the target CPU of the baseball apparatus.
Figure 33:
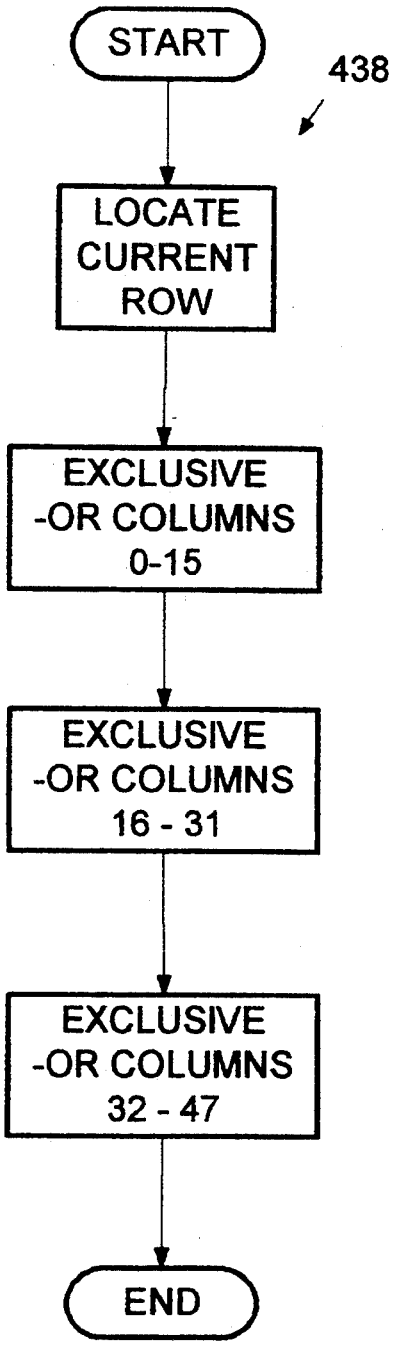
FIG. 33 is a flow diagram illustrating a shorts compensation routine of the target CPU of the baseball apparatus.

FIGS. 32 and 33 show details respectively of the shorts detection routine 432 and the shorts compensation routine 438 which cooperate to accommodate manufacturing defects in or damage to the target assembly 54 which results in permanent or intermittent short circuits between the row and column lines 65 and 66 of the target assembly 54. An initial target scan is run in the detection routine 432 in which, sequentially, each of the row lines 65 is pulled low and the column lines 66 are read and the state which is read is stored in a shorts table in memory. Any shorted junction is detected as a low bit in the three 16-bit words representing the column state for a given row. Thereafter, when the target scanning routine 444 for a game is executed, as each row is scanned and the column state words are read, the stored shorts compensation words are exclusive-ORed with the column state words to delete the effect of the defective junctions.

Figure 34:
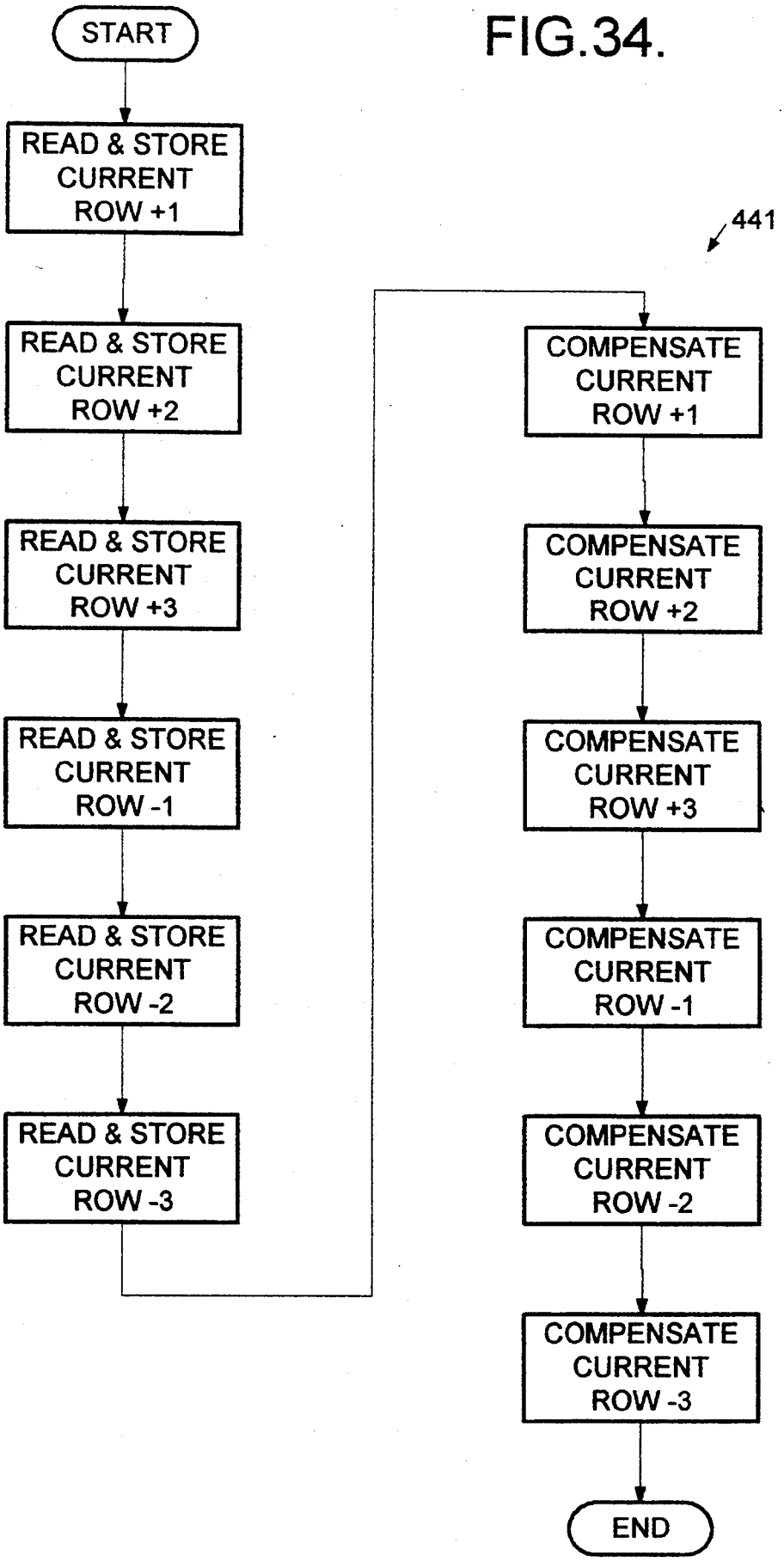
FIG. 34 is a flow diagram illustrating a routine target CPU of the baseball apparatus for obtaining an impact footprint.

The target CPU 120 continually scans the entire target until a contact is detected which is not negated by the shorts compensation routine 438. When such a contact is detected, an interrupt is asserted which causes the main target routine 430 to enter the footprint routine 441, detailed in FIG. 34. In the routine 441, the target CPU 120 concentrates scanning in the area of the detected contact by incrementing downward in the rows scanned from the detected contact and then decrementing upward from the detected contact. The result obtained is a set of coordinates defining the impact footprint of the ball 36 with the target face 55.

Figure 35:
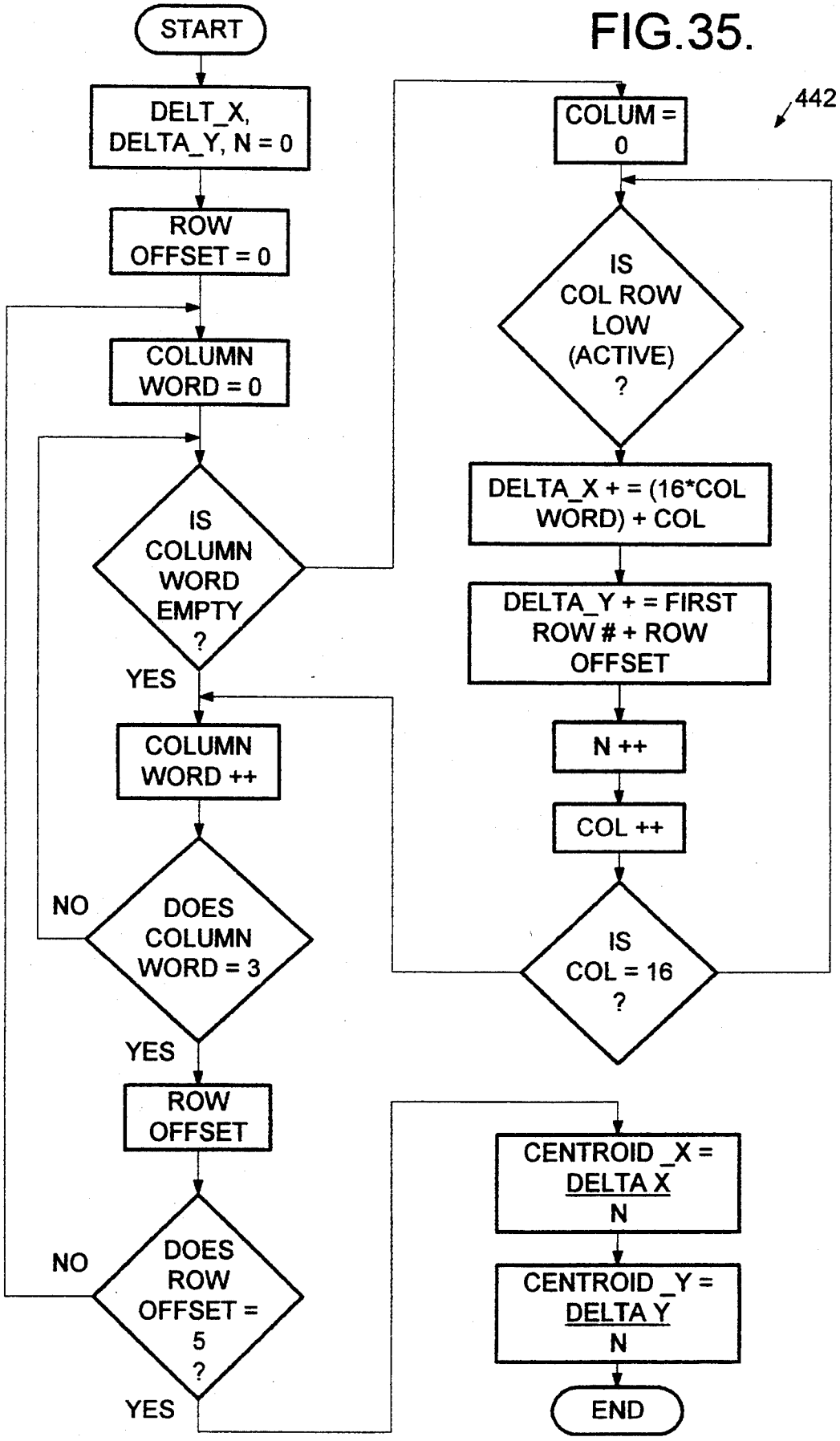
FIG. 35 is flow diagram illustrating a centroid calculation routine of the target CPU of the baseball apparatus.

FIG. 35 details the centroid calculation routine 442 in which the centroid of the impact footprint is calculated. Each of the intersections between the row lines 65 and the column lines 66 of the target matrix is assigned rectangular or Cartesian coordinates, that is, an (X,Y) coordinate pair. In the centroid calculation routine 442, the numeric values of the X and Y coordinates of all the contact intersections are essentially averaged by adding the numeric values of the X coordinates of all the contacts of the impact footprint and dividing by the quantity of contacts in the footprint. Similar calculations are performed on the Y coordinates of the contacts of the impact footprint. The result is an (X,Y) coordinate pair of a centroid of the impact footprint.

Figure 36:
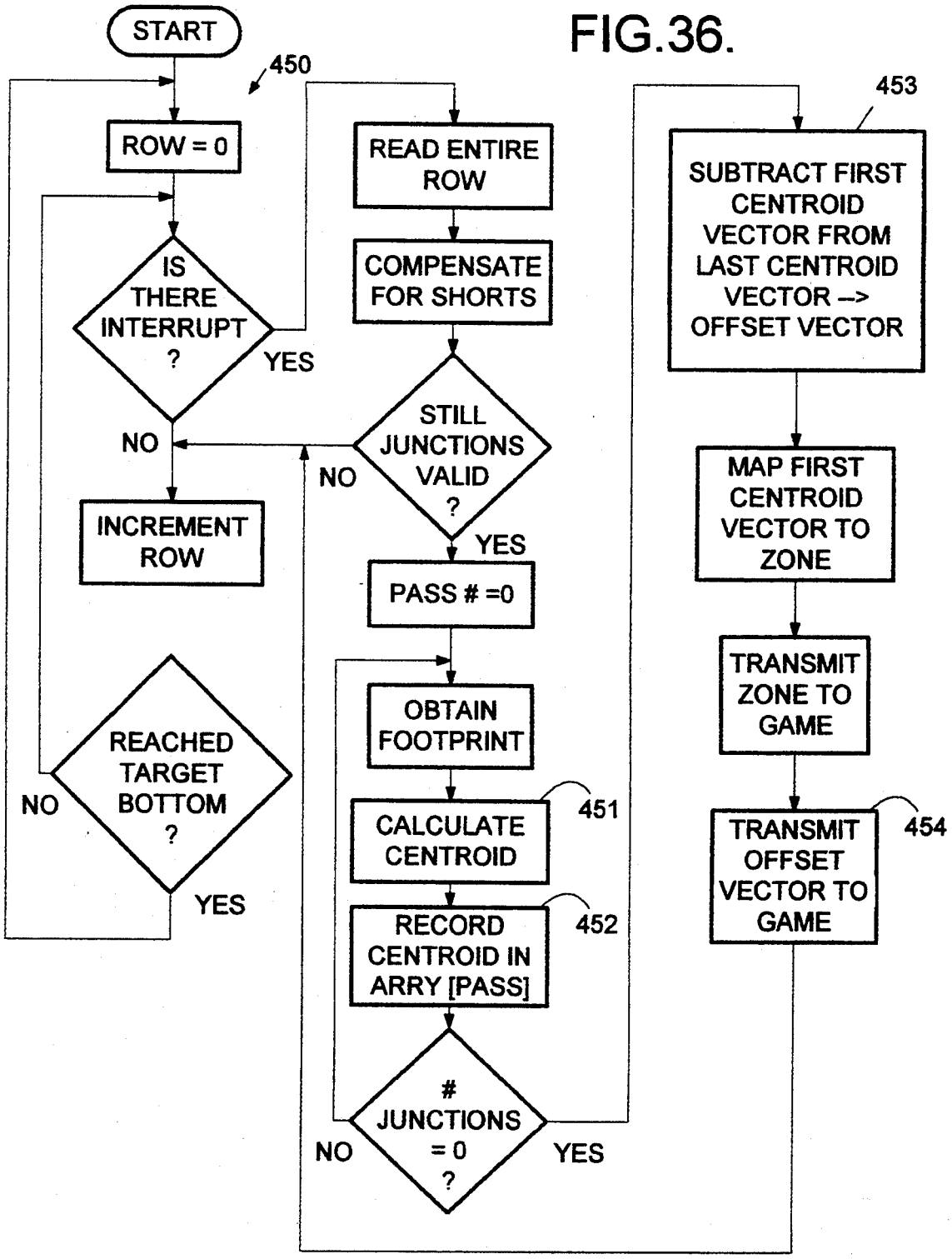
FIG. 36 is a flow diagram illustrating a modified main target routing in which a spin vector of an impacting ball is determined.

FIG. 36 illustrates a modified target processor main routine 450 in which the magnitude and direction of a spin vector of the impacting ball 36 is determined. Whereas the target routine 430 determines a single centroid of an impact footprint, the modified target routine 450 calculates and records, at blocks 451 and 452, the X and Y coordinates of a sequence of centroids of impact footprints during the short time that the impacting ball 36 is in contact with the target assembly 54. At block 453, the routine 450 calculates a spin vector of the impact using known vector mathematics to determine a spin direction and a relative spin magnitude. At block 454, data representing the calculated spin vector is transmitted to the main processor 150 and can be used by the main game software to enhance the player's score and to trigger appropriate voice messages to the player 35. In other respects, the modified main target routine is substantially similar to the main target routine 430.

Normal Play Mode and Game Strategy

The strategy of the game, if normal play is selected by the buttons 144, simply put, is to score the maximum number of points possible. Although it is tempting to a player to try to throw the ball as fast as he can, accuracy actually counts for as much or more than speed. The object of the game is to try to bring the count "full" to the batter, i.e. three Balls and two Strikes before throwing the third Strike. Preferably, each Ball and each Strike thrown will impact in a zone of maximum point value. Since the speed of each throw, except for Wild Pitches, is added to the accuracy score, it is important to throw with good velocity as well.

The digitized interactive voice messages from the voice module 151 add to the fun and challenge of the game by attracting, informing, encouraging, praising or admonishing the player. A typical sequence of player actions and voice responses would be:

To signify game play, the message "Play Ball" would be shouted.

For each ball thrown, an appropriate voice message is issued in response, i.e. for an impact in a Strike area, "Strike One (Two, Three)" as appropriate, and, for Strike Three, "You're Out of There". For impacts in a Ball zone, "Ball One (Two, Three, Four)" and, if Ball four, "Take a Walk". For a "Home Run" impact, "Hey Meatball, Stay Out of the Red", or "Hit the Corners." For a detected speed greater than 55 MPH, 65 MPH, etc., "That's not an Arm, That's a Rifle". To speed play, when the game is in play mode, "Well, Pitch It", for a low score at the end of a game, "You must watch a lot of baseball . . . On Radio", and for a high score, "Holy Cow, What do You do in the Off Season?". To attract additional playing after the game is over, "Thanks for Playing. Try Again!". Of course, the number of possible messages is practically endless.

Trainer Coach Mode

When the apparatus 1 is placed in the training mode by selecting the Trainer Coach format in the buttons 144, target impact zones are selected by the game CPU 150 and each selected zone is lit on the target display 131 on the control panel 42. When a particular zone is lit, the player tries to throw the ball at the zone on the target board 62 which is equivalent to the lit zone on the display 131. The game CPU 150 will select appropriate zones based upon the current pitch count to try to achieve a full count, with a final Strike zone selected when the count is full. Scoring can be similar to the normal play mode where scores for selected zones are added to pitching speed. Verbal and visual feedback messages are provided to indicate whether the correct zone has been hit.

While the apparatus 1 has been primarily illustrated and described with respect to a baseball pitcher's game, the apparatus 1 can be used as a serious pitching trainer. With spin detection capability, pitchers can be trained to improve specific pitches, or to develop new pitches, with their progress readily shown by spin and speed detection. In addition, it should be apparent that the general principles of operation can be equally applied to other games of skill. Examples include a golf trainer where the speed, spin and impact point of the ball would determine distance and direction. A video image of a golf hole could be projected onto the target board 62 in place of the fixed pitcher's target pattern. Other uses might include a thrown football game and trainer, a tennis serving trainer, or virtually any other skill game where a projectile is thrown or otherwise propelled at a target. In addition, the target board 62 can be used lying flat on a floor surface to detect a rolled ball or other object. With this position, for example, bowling games, Skeeball games, or other rolled ball games can be implemented.

It is to be understood that while certain forms of the present invention have been illustrated and described herein, it is not to be limited to the specific forms or arrangement of parts described and shown.

What is claimed and desired to be secured by Letters Patent is as follows:

1. A baseball pitcher's game and training apparatus comprising:

(a) a target including a deformable impact location detection means with an X–Y matrix of conductive rows and columns for providing an X–Y coordinate for the location of a deformation of said impact location means by a baseball; and (b) a programmable game computer connected to receive said X–Y coordinate from said impact location detection means, said game computer being programmed to calculate a game score based upon the accuracy of a ball thrown at said target.

2. An apparatus in accordance with claim 1, and further including:

(a) means for determining the speed of said ball thrown at said target.

3. An apparatus in accordance with claim 2, wherein:

(a) said computer is also programmed to calculate said score based upon said determined speed.

4. An apparatus in accordance with claim 3, and further comprising:
(a) a scoreboard and control panel connected to and controlled by said game computer, said panel comprising:
(i) a score and a speed display for indicating the current game score and the speed of the last thrown ball;
(ii) means for selecting between normal play and trainer coach modes; and
(iii) means for visually indicating other game conditions, including Ball count, Strike count, and Wild Pitch.

5. An apparatus in accordance with claim 4, wherein:
(a) said computer is programmed to "melt" said speed score into said game score by decrementing said speed display as said score display is incremented.

6. An apparatus in accordance with claim 1, and further comprising:
(a) a voice storage module connected to said game computer to provide interactive voice messages to a player.

7. An apparatus in accordance with claim 1, wherein said target and impact location detection means includes:
(a) a target board with said X–Y matrix of conductive rows and columns imbedded therein, with said rows and columns being normally separated by a separation layer but being urged into a plurality of electrical contacts at intersections of said rows and columns in the immediate area of said impact location as said ball impacts said target board; and
(b) means for scanning said rows and columns to detect said contact intersections to thereby detect said impact location.

8. An apparatus in accordance with claim 7, wherein said means for scanning also includes:
(a) means for determining a centroid of said impact location; and
(b) means for transmitting said centroid to said game computer.

9. An apparatus in accordance with claim 8, wherein:
(a) said centroid determining means includes means for determining a time based series of centroids of said impact location as said ball impacts said target;
(b) said means for transmitting transmits said time based series to said game computer; and
(c) said game computer is programmed to determine the direction and magnitude of spin of said ball as it impacts said target based upon said time based series of centroids.

10. An apparatus in accordance with claim 8, wherein:
(a) said means for scanning comprises a programmable target processor connected to a pair of field programmable gate arrays with a first gate array connected to said rows and a second gate array connected to said columns.

11. An apparatus in accordance with claim 10, wherein:
(a) said target board is positioned in a target receptacle which swings freely as said ball impacts it.

12. An apparatus in accordance with claim 11, and further including:
(a) means for directly attaching said target processor and said programmable gate arrays to said target board.

13. An apparatus in accordance with claim 12, wherein said means for attaching includes:
(a) a two-piece processor housing with a front housing member positionable on a front side of said target board and a rear housing member positionable on a rear side of said target board;
(b) a pair of protective impact-resistant plates positioned on a back side of said target board;
(c) a plurality of conductive ribbons connected to said X–Y matrix of conductors;
(d) a target processor circuit board;
(e) means for electrically connecting said processor circuit board to said conductive ribbons; and
(f) means for rigidly connecting said processor circuit board behind said protective plates and between said front and rear housing members.

14. An apparatus in accordance with claim 13, wherein:
(a) said pair of protective plates include a front, relatively large plate and a rear, relatively small plate positioned immediately behind said front plate; and
(b) each of said plates includes rounded corners to minimize impact damage to the plates and the processor board.

15. An apparatus in accordance with claim 10, and further comprising:
(a) a flat conductor for connecting said target processor to said game computer.

16. An apparatus in accordance with claim 1, and further comprising:
(a) a ball return for selectively returning said balls to a player.

17. An apparatus in accordance with claim 16, wherein said ball return comprises:
(a) an upwardly extending tube with an inside diameter greater than the outside diameter of said balls;
(b) a spiral means positioned within said tube and extending longitudinally from a bottom portion of said tube to a top portion of said tube;
(c) means for rotating said spiral means about its longitudinal axis; and
(d) inlet means for introducing balls into said bottom portion of said tube; whereby
(e) said balls are urged upward along said tube by the action of said rotating spiral means.

18. A ball return as in claim 17, wherein:
(a) said means for rotating comprises an electric motor connected to and selectively controlled by said game computer.

19. A ball return as in claim 17, and further comprising:
(a) a ball accumulation tray with a recess adapted to direct said balls from said tray toward said inlet means.

20. A ball return as in claim 19, and further comprising:
(a) an inclined ramp for propelling said balls from said target back to said accumulation tray.

21. A ball return as in claim 17, and further comprising:
(a) a ball sensing switch positioned within said tube in said top portion thereof to detect the presence of a ball in said tube top portion.

22. A projectile impact location detecting apparatus comprising:
(a) a layered board including
(i) a layer of a flexible material;
(ii) a layer of energy absorbing material;

(iii) a first circuit layer including a plurality of parallel conductive rows thereon;
(iv) a dielectric separation means;
(v) a second circuit layer with a plurality of parallel conductive columns thereon, said columns being orthogonal to said rows; and
(v) a rigid backing layer;
(b) means for scanning either said rows or columns sequentially with a set voltage while monitoring the other of said rows or columns for said set voltage; and
(c) said scanning means including means for determining said impact location depending upon which of said scanned rows or columns are being scanned and which of said monitored rows or columns are detected to have said set voltage.

23. An apparatus in accordance with claim 22, wherein said means for scanning also includes:
(a) means for determining a centroid of said impact location.

24. An apparatus in accordance with claim 23, wherein:
(a) said centroid determining means includes means for determining a time based series of centroids of said impact location as said projectile impacts said board; and said apparatus further includes:
(b) means for determining direction and magnitude of any spin of said projectile as it impacts said board based upon said time based series of centroids.

25. An apparatus in accordance with claim 22, wherein:
(a) said means for scanning comprises a programmable processor connected to a pair of field programmable gate arrays with a first gate array connected to said rows and a second gate array connected to said columns.

26. An apparatus in accordance with claim 22, wherein:
(a) said layer of flexible material includes a target image printed on a back side thereof.

27. An apparatus in accordance with claim 26, and further including:
(a) a wrinkle preventative layer positioned between said flexible layer and said energy absorbing layer.

28. An apparatus in accordance with claim 22, wherein:
(a) said dielectric separation means includes a pair of dielectric layers with each dielectric layer comprising a number of rows of apertures, each of said apertures being positioned at a junction between a conductive row and a respective conductive column.

29. An apparatus in accordance with claim 28, wherein:
(a) said dielectric layers are discontinuous along each row of apertures such that an air gap extends from each aperture to the edges of said board.

30. In a game apparatus in which balls are propelled toward a target, a ball return for selectively returning said balls from said target to a player, comprising:
(a) an upwardly extending tube with an inside diameter greater than the outside diameter of said balls;
(b) a spiral means positioned within said tube and extending longitudinally from a bottom portion of said tube to a top portion of said tube;
(c) means for rotating said spiral means about its longitudinal axis; and
(d) inlet means for introducing balls into said bottom portion of said tube; whereby
(e) said balls are urged upward along said tube by the action of said rotating spiral means.

31. A ball return as in claim 30, wherein:
(a) said means for rotating comprises an electric motor.

32. A ball return as in claim 30, wherein:
(a) said spiral means comprises a Teflon-coated spring.

33. A ball return as in claim 30, and further comprising:
(a) a ball accumulation tray with a recess positioned to direct said balls from said tray toward said inlet means.

34. A ball return as in claim 33, and further comprising:
(a) an inclined ramp for propelling said balls from said target back to said accumulation tray.

35. A ball return as in claim 30, and further comprising:
(a) a ball sensing switch positioned within said tube in said top portion thereof to detect the presence of a ball in said tube top portion.

36. A method of playing a projectile game which includes a target with an integral planar matrix of deformable impact sensors and comprising the steps of:
(a) propelling a game projectile toward said matrix to impact same;
(b) detecting a zone of impact of said projectile with said matrix by detecting a zone of deformation of said sensors and outputting an X–Y position of said impact zone; and
(c) receiving said X–Y position and impact scoring said impact based on said zone of impact.

37. A method as set forth in claim 36 and further including the steps of:
(a) measuring a speed of the propelled projectile using Doppler speed sensor means;
(b) speed scoring the speed of said propelled projectile; and
(c) adjusting said impact scoring step based on said speed scoring step.

38. A method as set forth in claim 36 wherein said matrix includes a plurality of conductive rows and an orthogonal plurality of conductive columns, and said detecting a zone of impact step includes the steps of:
(a) scanning said matrix to determine intersections of said rows and columns which have been shorted together as a result of said impact to develop an impact footprint; and
(b) calculating rectangular coordinates of a centroid of said footprint to determine said zone of impact.

39. A method as set forth in claim 38 and including the steps of:
(a) scanning said matrix to determine rectangular coordinates of a sequence of impact footprints;
(b) calculating rectangular coordinates of a sequence of centroids respectively of said sequence of impact footprints; and
(c) calculating a spin vector from said rectangular coordinates of said sequence of centroids to thereby determine a magnitude and direction of spin of said projectile upon impacting said matrix.

40. A method as set forth in claim 39 and wherein said projectile is a baseball and said planar matrix includes a baseball pitcher's target, said method further comprising the step of:

(a) determining, based upon said magnitude and direction of spin of said ball, whether a pitch is a fastball, curve, slider, or screwball.

41. A projectile impact location detecting apparatus comprising:

(a) a layered board including
  (i) a layer of a flexible material;
  (ii) a first circuit layer including a plurality of parallel conductive rows thereon;
  (iii) a dielectric separation means;
  (iv) a second circuit layer with a plurality of parallel conductive columns thereon, said columns being orthogonal to said rows; and
  (v) a rigid backing layer;

(b) means for scanning said first or second plurality of conductive lines sequentially with a set voltage while monitoring the remaining plurality of conductive lines for said set voltage; and (c) said scanning means including means for determining said impact location depending upon which of said first plurality of lines are being scanned and which of said second plurality of lines is detected to have said set voltage.

42. A baseball pitcher's game and training apparatus comprising:

(a) a target including an impact location detection means, said target comprising
  (i) a target board with an X–Y matrix of conductive rows and columns imbedded in said target board, with said rows and columns being normally separated by a separation layer but being urged into a plurality of electrical[contacts at intersections of said rows and columns in the immediate area of said impact location as said ball impacts said target board;
  (ii) means for scanning said rows and columns to detect said contact intersections to thereby detect said impact location;
  (iii) means for determining a centroid of said impact location and means for determining a time based series of centroids of said impact location as said ball impacts said target;

(b) a programmable game computer connected to said impact location detection means; and (c) means for transmitting said time based series of centroids to said game computer, said game computer being programmed to calculate a game score based upon the accuracy of a ball thrown at said target and to determine the direction and magnitude of spin of said ball as it impacts said target based upon said time based series of centroids.

43. A baseball pitcher's game and training apparatus comprising:

(a) a target including an impact location detection mean, said target including:
  (i) a target board with an X–Y matrix of conductive rows and columns imbedded in said target board, with said rows and columns being normally separated by a separation layer but being urged into a plurality of electrical contacts at intersections of said rows and columns in the immediate area of said impact: location as said ball impacts said target board;
  (ii) a target processor means for scanning said rows and columns to detect said contact intersections to thereby detect said impact location, said means for scanning comprising a programmable target processor connected to a pair of field programmable gate arrays with a first gate array connected to said rows and a second gate array connected to said columns; and
  (iii) means for directly attaching said target processor and said programmable gate arrays to said target board including:

(a) a two-piece processor housing with a front housing member positionable on a front side of said target board and a rear housing member positionable on a rear side of said target board;

(b) a pair of protective impact-resistant plates positioned on a back side of said target board;

(c) a plurality of conductive ribbons connected to said X–Y matrix of conductors;

(d) a target processor circuit board;

(e) means for electrically connecting said processor circuit board to said conductive ribbons; and (f) means for rigidly connecting said processor circuit board behind said protective plates and between said front and rear housing members; and (b) a programmable game computer connected to said target processor, said game computer being programmed to calculate a game score based upon the accuracy of a ball thrown at said target.

44. An apparatus in accordance with claim 43, wherein:

(a) said pair of protective plates include a front, relatively large plate and a rear, relatively small plate positioned immediately behind said front plate; and (b) each of said plates includes rounded corners to minimize impact damage to the plates and the processor board.

45. A baseball pitcher's game and training apparatus comprising:

(a) a target including an impact location detection means;

(b) a programmable game computer connected to said target processor, said game computer being programmed to calculate a game score based upon the accuracy of a ball thrown at said target;

(c) a ball return for selectively returning said balls to a player, said ball return comprising:
  (i) an upwardly extending tube with an inside diameter greater than the outside diameter of said balls;
  (ii) a spiral means positioned within said tube and extending longitudinally from a bottom portion of said tube to a top portion of said tube;
  (iii) means for rotating said spiral means about its longitudinal axis; and
  (iv) inlet means for introducing balls into said bottom portion of said tube; whereby
  (v) said balls are urged upward along said tube by the action of said rotating spiral means.

46. A ball return as in claim 45, wherein:

(a) said means for rotating comprises an electric motor connected to and selectively controlled by said game computer.

47. A ball return as in claim 45, and further comprising:

(a) a ball accumulation tray with a recess adapted to direct said balls from said tray toward said inlet means.

48. A ball return as in claim 47, and further comprising:

(a) an inclined ramp for propelling said balls from said target back to said accumulation tray.

49. A ball return as in claim 45, and further comprising:

(a) a ball sensing switch positioned within said tube in said top portion thereof to detect the presence of a ball in said tube top portion.

50. A projectile impact location detecting apparatus comprising:

(a) a layered board including:
  (i) a layer of a flexible material;
  (ii) a layer of energy absorbing material;
  (iii) a first circuit layer including a plurality of parallel conductive rows thereon;
  (iv) a dielectric separation means;
  (v) a second circuit layer with a plurality of parallel conductive columns thereon, said columns being orthogonal to said rows; and
  (vi) a rigid backing layer;

(b) means for scanning said conductive rows or columns sequentially with a set voltage while monitoring the other of said rows or columns for said set voltage, said scanning means including:
  (i) means for determining said impact location depending upon which of said scanned rows or columns are being scanned and which of said monitored rows or columns are detected to have said set voltage; and
  (ii) means for determining a centroid of said impact location, said means for determining also including means for determining a time based series of centroids of said impact location as said projectile impacts said board; and (c) means for determining direction and magnitude of any spin of said projectile as it impacts said board based upon said time based series of centroids.

51. A projectile impact location detecting apparatus comprising:

(a) a layered board including:
  (i) a layer of a flexible material;
  (ii) a layer of energy absorbing material;
  (iii) a first circuit layer including a plurality of parallel conductive rows thereon;
  (iv) a second circuit layer with a plurality of parallel conductive columns thereon, said columns being orthogonal to said rows;
  (v) a dielectric separation means including a dielectric layer comprising a number of rows of apertures, each of said apertures being positioned at a junction between a conductive row and a conductive column, said dielectric layer being discontinuous along each row of apertures such that an air gap extends from each aperture to the edges of said board; and
  (vi) a rigid backing layer; and (b) means for scanning said rows or columns sequentially with a set voltage while monitoring the other of said rows and columns for said set voltage, said scanning means including means for determining said impact location depending upon which of said rows or columns are being scanned and which of the other of said rows or columns are detected to have said set voltage.

52. A method of playing a projectile game which includes a planar matrix of impact sensors including a plurality of conductive rows and an orthogonal plurality of conductive columns, said method comprising the steps of:

(a) propelling a game projectile toward said matrix to impact same;

(b) detecting a zone of impact of said projectile with said matrix by:
  (i) scanning said matrix to determine intersections of said rows and columns which have been shorted together as a result of said impact to develop an impact footprint;
  (ii) repeatedly scanning said matrix to determine rectangular coordinates of a sequence of impact footprints;
  (iii) calculating rectangular coordinates of a sequence of centroids respectively of said sequence of impact footprints; and
  (iv) calculating a spin vector from said rectangular coordinates of said sequence of centroids to thereby determine a magnitude and direction of spin of said projectile upon impacting said matrix.

53. A method as set forth in claim 52 and wherein said projectile is a baseball and said planar matrix includes a baseball pitcher's target, said method :further comprising the step of:

(a) determining, based upon said magnitude and direction of spin of said ball, whether a pitch is a fastball, curve, slider, or screwball.

* * * * *